US006741214B1

(12) United States Patent
Kadambi et al.

(10) Patent No.: US 6,741,214 B1
(45) Date of Patent: May 25, 2004

(54) PLANAR INVERTED-F-ANTENNA (PIFA) HAVING A SLOTTED RADIATING ELEMENT PROVIDING GLOBAL CELLULAR AND GPS-BLUETOOTH FREQUENCY RESPONSE

(75) Inventors: Govind Rangaswamy Kadambi, Lincoln, NE (US); Theodore Samuel Hebron, Lincoln, NE (US); Antonio Barron Meza, Lincoln, NE (US); Sripathi Yarasi, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 7 days.

(21) Appl. No.: 10/288,965

(22) Filed: Nov. 6, 2002

(51) Int. Cl.[7] ..... H01Q 1/38

(52) U.S. Cl. ..... 343/700 MS; 343/702; 343/767; 343/770; 343/846

(58) Field of Search ..... 343/700 MS, 702, 343/67, 770, 846, 848

(56) References Cited

U.S. PATENT DOCUMENTS 6,573,869 B2 * 6/2003 Moore ..... 343/702

6,639,560 B1 * 10/2003 Sullivan et al. ..... 343/700 MS

* cited by examiner

*Primary Examiner*—Hoang V. Nguyen
(74) *Attorney, Agent, or Firm*—Holland & Hart LLP

(57) ABSTRACT

Single feed planar inverted-F antennas (PIFAs) are provided for three, four or five frequency bands of resonance in both cellular and non-cellular frequency bands. The PIFAs include a dielectric carriage having a metal radiating element located on a top surface thereof and sidewalls having a metal ground plane element located at the bottom of the sidewalls. The non-radiating edge of the radiating elements include a downward extending shorting strip that is connected to the ground plane element and a downward extending feed strip that is spaced above the ground plane element and is connected to a feed cable. The radiating element includes downward extending matching and loading plates whose free ends are spaced above the ground plane element, which provide impedance matching and reactive loading to the radiating elements. Configurations of slots (open and closed) within the radiating elements selectively provide multiple frequency resonance to the radiating elements in both cellular and non-cellular frequency bands.

34 Claims, 7 Drawing Sheets

PLANAR INVERTED-F-ANTENNA (PIFA) HAVING A SLOTTED RADIATING ELEMENT PROVIDING GLOBAL CELLULAR AND GPS-BLUETOOTH FREQUENCY RESPONSE

RELATED PATENT APPLICATION

U.S. non-provisional patent application Ser. No. 10/135,312, filed Apr. 29, 2002, entitled "A Single Feed Tri-band PIFA with Parasitic Element by Govind Kadambi and Jon Sullivan", incorporated herein by reference.

BACKGROUND OF THE INVENTION

1. Field of the Invention:

The present invention relates to a Planar Inverted F-Antenna (PIFA), and in particular, to a single feed, multi band (Three, four or five band) PIFA whose radiating/receiving element contains one or more slots.

2. Description of Related Art:

With the rapid progress of cellular communication and the increasing demand for multi systems application, there is a trend toward the design of multi purpose, multi band, cellular handsets, i.e. cellular wireless communications devices.

This demand has advanced from two band cellular antennas to three band antennas that cover the lower US or European cellular band, as well as the digital calling selecting (DCS) and personal communication service (PCS) bands.

It is reasonable to foresee a future requirement for a single antenna that covers the AMPS/PCS and GSM/DCS bands for global cellular communications (wherein AMPS stands for advanced mobile phone service, also called North American cellular phone system, and wherein GSM stands for global system for mobile communications).

There is also a desire to use cellular antennas that are internal to a wireless communication device such as a cellular handset. Since an internal antenna is integrated into, or buried within, the wireless communication device, an internal antenna eliminates any antenna element that protrudes outward from the body of the wireless communication device.

Internal antennas have several advantages, such as being less prone to damage, a reduction in the size of the handset, and increased portability of the handset. When an internal antenna is provided, the wireless communication device's printed circuit board may also serve as a ground plane element for the internal antenna.

Among the choices that are available for internal antennas, a planar inverted-F antenna (PIFA) has great promise. PIFAs have many distinguishing properties, such as being relative lightweight, ease of adaptation and integration into the wireless communication device's chassis, a moderate range of bandwidth, omni directional radiation patterns in orthogonal principal planes for vertical polarization, versatility for optimization, and arrangements to achieve size reduction. The sensitivity of PIFAs to both vertical and horizontal polarization is of practical importance in mobile cellular/RF data communication applications due to the absence of a requirement for a fixed orientation of the antenna, as well as multi path propagation conditions. All of these features make a PIFA a good choice for use as an internal antenna for mobile cellular/RF data communication applications.

In the past, success has been achieved in the design of a single feed PIFA having two resonant frequencies, this resulting in a two band PIFA. In view of the inherent bandwidth limitations that are associated with conventional PIFA designs, most of the prior art single feed, two band, PIFAs exhibit useful and desirable performance that covers only two cellular frequency bands.

U.S. Pat. No. 5,926,139 (incorporated herein by reference), and a paper by Liu. et. al. entitled "Dual Frequency Planar Inverted—F Antenna", IEEE Trans. Antenna and Propagation, Vol. AP-45, No. 10, pp. 1451–1548, Oct. 1997, are examples of the prior single feed, dual band, PIFAs.

FIGS. 6*a* and 6*b* illustrate a prior art single feed, two band, PIFA 50. Dual band PIFA 50 that includes a radiating/receiving element 301 (hereinafter radiating element) and a ground plane 302. An L-shaped open slot 303 within radiating element 301 provides quasi-physical partitioning of radiating element 301.

The portion of radiating element 301 having the dimensions of length L1 and width W1 resonates at the lower frequency band of the PIFA's dual band operation. The portion of radiating element 301 having the dimensions of length L2 and width W2 resonates at the upper frequency band of the dual band operation.

A power feedhole 304 is located in radiating element 301, and a connector feed pin 305 that feeds radio frequency (RF) power to radiating element 301 is inserted through feedhole 304 from the bottom surface of ground plane 302. Connector feed pin 305 is electrically insulated from ground plane 302 at the point where feed pin 305 passes through a hole that is provided in ground plane 302. Connector feed pin 305 is electrically connected to radiating element 301 at 306.

The outer body portion 314 of the connector that includes feed pin 305 is connected to ground plane 302 at 307, and feed pin 305 is electrically insulated from the outer body portion 314 of this connector.

A hole 308 is provided in radiating element 301, and a conductive post or pin 309 which provides a short circuit between radiating element 301 and ground plane 302 is inserted through hole 308. Conductive post 309 is connected to radiating element 301 at 310, and is connected to ground plane 302 at 311.

Dual band impedance matching of radiating element 301 is determined by the diameter of connector feed pin 305, by the diameter of conductive shorting post 309, and by the separation distance that exists between connector feed pin 305 and conductive shorting post 309.

A disadvantage of the dual band PIFA 50 illustrated in FIGS. 6*a* and 6*b* is the lack of a simple means of adjusting the frequency separation between the antenna's lower and the upper resonant frequency bands. A change in the frequency separation of these two resonant frequency bands requires the repositioning of an L-shaped slot 303 that is formed in radiating element 301. PIFA 50 also provides a constraint on a realizable bandwidth that is centered around the two resonant frequencies of PIFA 50.

Techniques for enhancing the bandwidth around the two resonant frequencies of PIFA 50 are of practical importance. Depending upon the bandwidth that is achievable around the two resonant frequencies, dual resonant PIFA 50 may potentially cover more than two frequency bands.

For the design of a dual band (i.e. a dual resonance) PIFA that covers the AMPS/PCS and the GSM/DCS bands for global cellular communications, the bandwidth requirement of the lower resonance of a PIFA that covers both the AMPS and the GSM bands is about 15.29%, when compared to about 8.15% for the AMPS band only. Likewise, the bandwidth requirement of the upper resonance of a PIFA that covers both the DCS and PCS bands is about 15.14%, as compared to about 7.29% required for the PCS band only.

Attempts have been made to improve the bandwidth centered around the upper resonant frequency of a dual band PIFA in order to realize three or tri band performance that covers three cellular frequency bands.

Simultaneously enhancing the bandwidth centered around the two resonant frequencies of a dual band cellular PIFA in order to accomplish the four or quad band operation that is essential for global cellular coverage or applications is not known.

Therefore, a single feed, four band, PIFA comprising the four basic frequency bands of global cellular communication is needed by the art, and such a single feed, quad band, PIFA is of practical importance for the emerging trend of a single cellular handset for global cellular coverage.

In order to keep pace with another category of recent advance in cellular communications, there is a requirement for a single antenna that simultaneously covers both cellular and non-cellular applications, examples of non-cellular applications being global positioning system (GPS) and Bluetooth (BT) (wherein Bluetooth is a code name for a proposed open specification to standardize data synchronization between disparate PC and handheld PC devices).

System applications like GPS and BT or IEEE 802.11 have frequency bands that are significantly off of the dual cellular bands of AMPS/GSM and DCS/PCS. An inherent problem is the bandwidth requirement for the upper resonant band of an antenna to simultaneously cover the upper cellular (DCS or PCS) frequencies and the non-cellular (GPS or BT) frequencies.

Enhancing the bandwidth of a cellular, dual band, PIFA to additionally cover GPS and BT applications is difficult. Extension of currently available cellular dual band PIFAs to additionally cover the GPS and the BT frequency bands requires a rather non-realizable bandwidth that is centered around these two cellular frequencies. For example, extending the operation of a cellular, dual band (AMPS/PCS), PIFA to cover the GPS band implies a bandwidth requirement of about 23.35% for the GPS/PCS bands (1575 to 1990 MHz), and the corresponding bandwidth requirement to cover the GPS/DCS bands (1575 to 1880 MHz) is about 17.72%.

Extending the operation of a cellular, dual band (AMPS/PCS), PIFA to cover the industrial scientific medical (ISM) band requires a bandwidth of about 29.89% for the PCS/ISM bands (1850 to 2500 MHz). It is difficult to achieve such a wide bandwidth using known single feed, dual band, PIFAs.

The present invention provides single feed, three band, four band and five band, PIFAs for simultaneous cellular and non-cellular applications.

A single feed, three band, PIFA for both cellular and non-cellular (GPS or ISM) applications is described in above-referenced U.S. Pat. disclosure Ser. No. 10/135,312. In the above-referenced patent application, a third resonant frequency of the PIFA is provided by a shorted parasitic element that is placed between the PIFA's radiating element and the ground plane. This parasitic element is placed internal to a dual cellular band PIFA in order to provide a third and exclusively non-cellular resonant frequency band for the PIFA. While this referenced patent application deals with a three band (two cellular bands and one non-cellular band) PIFA, the present invention deals with a single feed, four band, (two cellular bands and two non-cellular bands) PIFA, or a single feed, five band (three cellular bands and two non-cellular bands), PIFA, wherein the PIFAs overcome the enormity of the bandwidth requirement that the PIFA's upper resonant frequency band should simultaneously cover both the upper cellular frequency and the upper non-cellular frequency.

Embodiments of single feed, multi band, PIFAs (for both Cellular and Non-cellular applications) in accordance with this invention include:

(a) A combined L-shaped slot and annular slot for four band operation (four cellular bands), see FIGS. 1*a*, 1*b*, 1*c*, 2*a*, 2*b* and 2*c*.

(b) Two generally L-shaped slots and one generally C-shaped slot for five band operation (three cellular bands and two non-cellular bands), see FIGS. 3*a*, 3*b* and 3*c*.

(c) A single annular slot for three band operation (two cellular bands and one non-cellular band), see FIGS. 4*a* and 4*b*.

(d) Two annular slots for four band operation (two cellular bands and two non-cellular bands), see FIGS. 5*a* and 5*b*.

Single feed, multi band, PIFAs of the present invention which provide for the simultaneous inclusion of both cellular and non-cellular resonant bands do not require an increase in the overall physical size or volume of the PIFAs, and therefore provide a desirable feature of compactness, despite the PIFA's multi band operational capability.

SUMMARY OF THE INVENTION

This invention provides PIFA embodiments having a single feed and having three, four or five frequency band operation.

Multiple frequency PIFAs in accordance with this invention include a variety of combinations that are useful for many systems application. Multi frequency operation of a single feed PIFA in accordance with this invention include, but are not limited to:

(a) Four band for global cellular coverage (i.e. AMPS/PCS/GSM/DCS), see FIGS. 1*a*, 1*b*, 1*c*, 2*a*, 2*b* and 2*c*.

(b) Five band for three cellular band coverage and two non cellular band coverage (i.e. AMPS/DCS/PCS cellular or GSM/DCS/PCS cellular and GPS/ISM or GPS/BT non-cellular), see FIGS. 3*a*, 3*b* and 3*c*.

(c) Three band for two cellular band coverage and one non cellular band coverage (i.e. AMPS/PCS or GSM/DCS and GPS or BT), see FIGS. 4*a* and 4*b*.

(d) Four band for two cellular band coverage and two non cellular band coverage (i.e. AMPS/PCS or GSM/DCS and GPS/ISM or GPS/BT), see FIGS. 5*a* and 5*b*.

A single feed, four band (AMPS/GSM/DCS/PCS cellular bands), PIFA forms the first embodiment of this invention, wherein the four band operation is provided for by the combination of an L-shaped slot with an annular slot, resulting in a composite slot in the radiating element of the PIFA.

Although the use of an L-shaped slot is shown in prior art FIGS. 6*a* and 6*b*, the present invention's advantages that are provided by a required location of the L-shaped slot with respect to the positions of the PIFA's feed post and shorting post are not offered by the prior art. More specifically, the first embodiment of this invention locates the open end of an L-shaped slot portion between the radiating element's feed post and shorting post. This location of the open end of the L-shaped slot portion between the feed post (or strip) and the shorting post (or strip) results in two resonant frequency bands having a relatively wide bandwidth that is centered around the two resonant frequencies.

The length of the L-shaped slot portion of this first embodiment provides reactive loading on the resonant frequencies of the PIFA, and as a result the resonant frequencies can be lowered or reduced without increasing the physical size of the PIFA.

In this first embodiment of the invention an annular slot portion having a generally rectangular shape extends generally parallel to the four outer edges of the PIFA's radiating element, thus forming a generally rectangular inner radiating element and a generally C-shaped main or outer radiating element that surrounds the inner radiating element.

The physical size and the location of the annular slot portion is such that the annular slot portion merges or combines with a horizontal segment of the L-shaped slot portion. That is, the annular slot portion merges or combines with a segment of the L-shaped slot portion that extends generally parallel to the minor or short axis of the PIFA's ground plane element.

Importantly, a common region of overlap of the two slot portions is in close vicinity of the non radiating edge of the radiating/receiving element that contains the PIFA's feed strip and shorting strip.

The PIFA's inner radiating element and outer radiating element are electrically connected by way of a conductive stub that is located within the annular slot portion, and this conductive stub is located in close proximity to the radiating edge of the radiating element, i.e. the edge that is opposite the feed strip and shorting strip. This conductive stub is placed within the annular slot at this location so as to form a tuning element that controls the resonance frequency characteristics of the PIFA's radiating element.

The PIFA's resonant frequencies, and the associated bandwidth that is centered around these two resonant frequencies, are determined by the following design parameters:

(a) The position of the shorting strip,
(b) The width of the shorting strip,
(c) The position of the feed strip,
(d) The width of the feed strip,
(e) The location of the open end of the L-shaped slot portion on the non radiating edge of the radiating element, i.e. the edge that contains the shorting strip and feed strip,
(f) The size and width of the segment of the L-shaped slot portion that is parallel to the major or long axis of the ground plane,
(g) The size and location of the annular slot portion,
(h) The location of the conductive stub that electrically connects the inner and outer radiating elements, and
(i) The width of the conductive stub.

Based on a combination of the L-shaped slot portion and the annular slot portion to form a composite slot, as well as the placement of the open end of the L-shaped slot portion between the feed strip and the shorting strip, a single feed, four band (AMPS/GSM/DCS/PCS), PIFA is provided having satisfactory bandwidth. The single feed, four band, PIFA of the first embodiment of this invention provides good gain performance in all the four cellular bands that are required for global coverage. The single feed, four band, PIFA covers the four basic frequency bands of global cellular communication as proposed in the first embodiment of this invention.

The present invention also provides embodiments of a single feed PIFA having three resonant frequencies or four resonant frequencies covering the dual cellular and the GPS or the BT frequencies, as well as two cellular and two non cellular frequencies.

A single feed, five band (three cellular bands and two non-cellular bands, PIFA comprises a second embodiment of the present invention. This second embodiment of the invention provides two L-shaped slots and one C-shaped slot within the PIFA's radiating element, with the open ends of all of the slots being located on the non radiating edge of the radiating element that contains a shorting strip and a feed strip.

As with the first embodiment of the invention, a first L-shaped slot has its open end located between the feed strip and shorting strip. The open end of the C-shaped slot is located to the other side of the feed strip, and the open end of the second L-shaped slot is located between the open end of the C-shaped slot, and an adjacent side edge of the radiating element.

The positions and the contours of these three slots provide four distinct resonant frequencies for the single feed PIFA of this second embodiment of the invention.

The L-shaped slot that is located between the feed strip and shorting strip provides two distinct resonant bands. The two other slots provide separate resonant frequency bands having distinct resonant frequencies.

Performance of this second embodiment of the invention centered around a first resonance is optimized for the AMPS band. The bandwidth of this second embodiment centered around a third resonance frequency includes the two upper cellular bands DCS and PCS. Thus, a combination of the first and the third resonance frequency of the second embodiment of the invention provides three-cellular band performance.

Similarly, two non-cellular band performance of the second embodiment of the invention is provided by way of the second and a fourth resonance frequency of the PIFA. Specifically, resonance of the PIFA in the lower non-cellular frequency band (GPS) is provided by tuning the second resonant frequency as a function of the position of the second L-shaped slot. The requirement of resonance in the upper non-cellular frequency band (ISM or BT) is provided by optimizing the bandwidth performance centered around the fourth resonant frequency of the PIFA.

The above-mentioned use of two L-shaped slots and one C-shaped slot on a PIFA's radiating element provides a single feed, five band, PIFA. This single feed, five band, PIFA is provided using concepts that are also utilized in the above-mentioned first embodiment of the invention, and exhibits satisfactory gain and bandwidth at three cellular bands and two non cellular bands.

A single feed, three band, PIFA (two cellular bands and one non cellular band) having a single annular slot forms the third embodiment of the invention wherein the dual resonant cellular frequencies are provided by a radiating element that includes a shorting strip and capacitive loading.

The desired separation between the two cellular frequency bands of the single feed PIFA is initially optimized by varying the position of a shorting strip that is located along the non radiating edge of the radiating element (i.e. the edge that is closest to a corresponding end of the ground plane), and by varying the position of the shorting strip along this non-radiating edge of the radiating element that is parallel to the minor axis of the ground plane element.

Parameters such as the width of the shorting strip, the location of the feed strip, and the size of the shorting strip determine a bandwidth centered around the two resonant frequencies, and these parameters are optimized to provide a dual cellular performance of the PIFA.

Resonance in the non-cellular band, which is distinctly far off from the two cellular bands, constitutes the third resonant frequency of the PIFA, and this third resonant frequency is generated by placement of an annular slot within the radiating element, the annular slot dividing the PIFA's radiating element into inner and outer radiating elements. Placement of conductive stubs at pre-desired locations within the contour of the annular slot results in the modified C-shaped inner radiating element. Because of the above-mentioned conductive stub, the annular slot transforms to a C-shaped slot.

A conductive stub is placed at a desired location within the annular slot, to electrically connect the inner radiating element to the outer radiating element. The width of the annular slot and the perimeter of the inner radiating element control the bandwidth and the resonant frequency of the third or non-cellular resonance band of the multi band PIFA in accordance with the third embodiment of the invention. In addition, the width and the position of the conductive stub form tuning parameters that control and vary the resonant frequency of the third or non-cellular band of the PIFA.

The width of the annular slot, the perimeter of the annular slot, the location of the annular slot, and the width and the position of the conductive stub that connects the inner radiating element to the outer radiating element, are optimized to provide the third resonance frequency of the PIFA in the non-cellular frequency band.

In a fourth embodiment of this invention the above-described single feed, three band, PIFA having a single annular slot is modified to provide a single feed, four band, PIFA by incorporation two annular slots within the PIFA's radiating element. This fourth embodiment provides four distinct resonant frequencies for the single feed PIFA, thus simultaneous providing for two cellular bands and two non-cellular bands of operation.

In this fourth embodiment wherein a single feed, four band, PIFA includes two annular slots, a second annular slot is placed within a first annular slot.

As with the above-described three band PIFA of the third embodiment of this invention, the desired bandwidth for the two band cellular performance of the PIFA of the fourth embodiment is accomplished by optimizing parameters such as the dimensions of the radiating element, the height of the PIFA, the location and width of the shorting strip, as well as the location and size of the feed strip.

Resonance of the PIFA in the lower non-cellular frequency band is provided by the first (outer) annular slot. The first annular slot is of a substantially rectangular shape and results in the formation of a generally C-shaped first inner radiating element. The first annular slot also separates the C-shaped first inner radiating element from an outer radiating element. A first conductive stub is placed within the first annular slot to electrically connect the C-shaped first inner radiating element to the outer radiating element.

The width of this first annular slot, and the perimeter of this C-shaped first inner radiating element, control the bandwidth and the resonant frequency of the lower non-cellular resonance of the multi band PIFA of the fourth embodiment. In addition, the width and the position of the first conductive stub that connects the C-shaped first inner radiating element to the outer radiating element form additional tuning parameters that control and vary the resonant frequency of the lower non cellular band of the multi band PIFA.

The width and the perimeter of the first annular slot, the location of the first annular slot, the width and the position of the first conductive stub that connects the C-shaped first inner radiating element to the outer radiating element are parameters that are optimized to obtain the third resonance of the PIFA in the non cellular frequency band.

In the fourth embodiment of the invention, resonance of the multi band PIFA in the upper non-cellular frequency band is provided by a second (inner) annular slot. This second annular slot is of substantially rectangular shape. It is encompassed by the C-shaped first inner radiating element, and it forms a generally rectangular second inner radiating element.

A second conductive stub is placed at within this second annular slot to electrically connect the rectangular second inner radiating element to the C-shaped first inner radiating element. The width of the second annular slot and the perimeter of the C-shaped second inner radiating element control the bandwidth and the resonant frequency of the fourth or upper non cellular resonance band of the multi band PIFA of this fourth embodiment. Placement of a second conductive stub in the second annular slot modifies the rectangular shape of the second inner element to that of a generally C-shape. Because of the above-mentioned second conductive stub, the second annular slot transforms into a second generally C-shaped slot.

In addition, the width and the position of the second conductive stub act as tuning means that control and vary the resonant frequency of the upper non-cellular band of the multi band PIFA of the fourth embodiment of the invention.

Resonance of the multi band PIFA in the upper non cellular frequency band is provided by optimizing parameters such as the width and the perimeter of the second annular slot, the location of the second annular slot, and the width and position of the second conductive stub that connects the C-shaped first inner radiating element to the C-shaped second inner radiating element.

Providing three, four or five band PIFAs in accordance with the various embodiments of this invention involves the modification of a single feed, two band, PIFA. The modifications that are provided by this invention enhance the dual or two band capability of prior art PIFAs, and the modifications are easy to implement. Modifications that are made to a single feed, two band, PIFA do not increase the volume or the linear dimensions of the prior art PIFAs, thus retaining the desirable compactness of a prior PIFAs.

Since PIFAs in accordance with this invention provide more than two resonant frequencies within the cellular and non-cellular bands, it is much easier to achieve a required bandwidth that is centered around the multiple resonant frequencies for three band, four or five band operation of a PIFA.

For example, in order to extend the operation of a cellular, two band, PIFA so as to include the GPS band, PIFAs in accordance with this invention require a bandwidth of only about 7.29% in PCS band, and only about 0.13% in GPS band, instead of a bandwidth of about 23.35% that is needed to cover the combined GPS/PCS bands (1575 to 1990 MHz). Similarly, in order to extend operation of a cellular, two band (GSM/DCS), PIFA in order to cover the ISM band, the bandwidth requirement for a PIFA in accordance with this invention is only about 9.47% in DCS band, and about 4.08% in ISM band, as compared to a bandwidth of about 37.52% for the combined DCS/ISM bands (1710 to 2500 MHz).

Therefore the present invention's single feed, three, four or five band, PIFAs, that are provided by embodiments of this invention, offer the new and unusual feature of overcoming the enormity of a bandwidth requirement that is centered around any specific resonance frequency that covers two cellular frequency bands and one non-cellular frequency band.

This invention ensures that a single feed, three band, four band or five band, PIFA in accordance with the invention provides for the simultaneous coverage of multiple cellular and non cellular frequency bands, and does not require an increase in the overall volume or size of the PIFA.

This invention provides a single feed, three band, four band or five band, PIFA that is of simple construction, that is compact in size, and that is cost effective to manufacture and fabricate.

BRIEF DESCRIPTION OF THE DRAWINGS

FIG. 5*a* and 5*b* are respectively similar to FIGS. 4*a* and 4*b*, wherein FIGS. 5*a* and 5*b* are top perspective views of the radiating element of a single feed, four band, PIFA in accordance with a fourth embodiment of the invention wherein the top surface of the radiating element includes two annular slots that partition the radiating element into a generally rectangular outer radiating element, a generally C-shaped first inner radiating element that is adjacent to and surrounds a generally C-shaped second inner radiating element.

DETAILED DESCRIPTION OF THE INVENTION

Figure 1A:
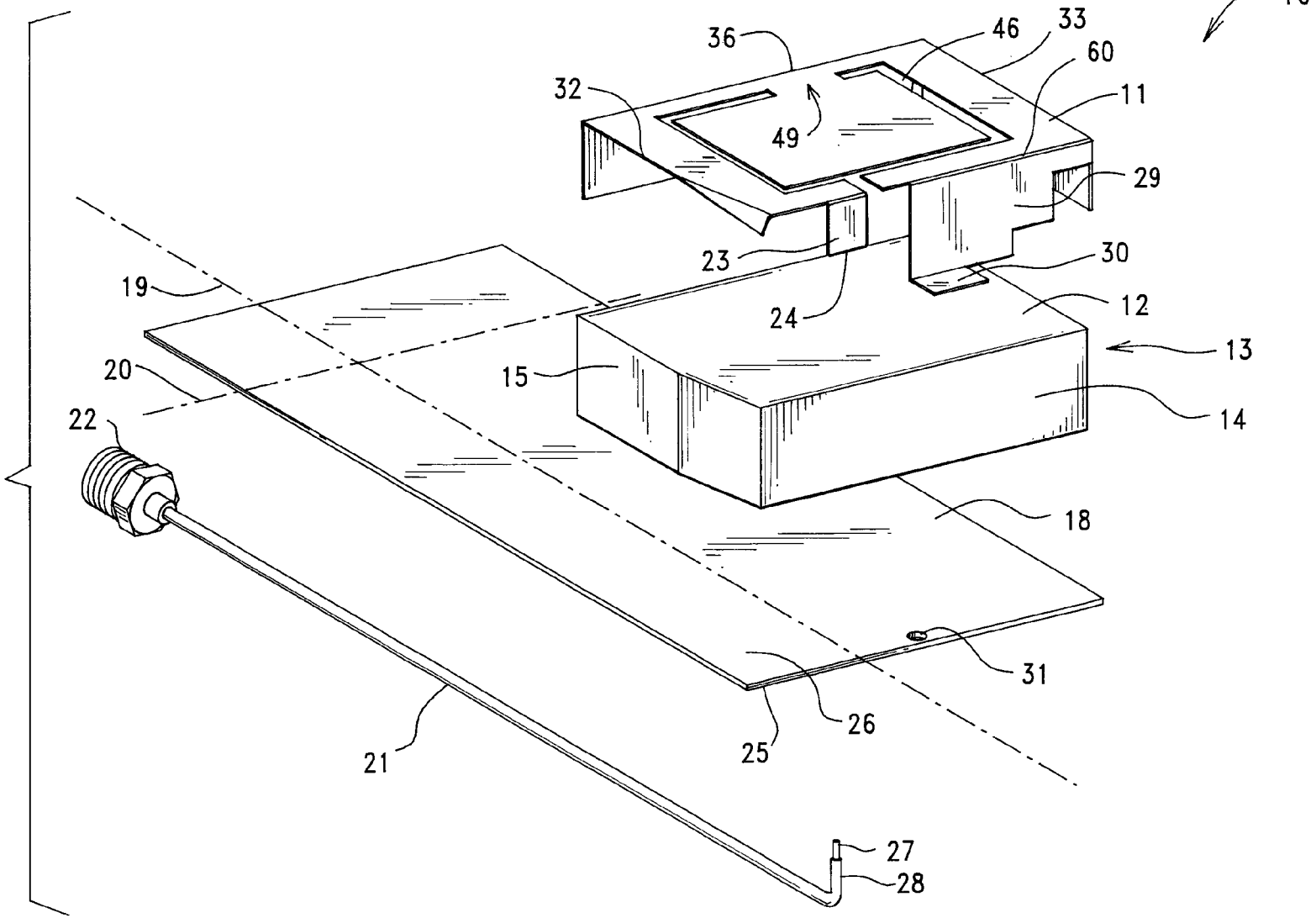
FIG. 1*a* is an exploded view showing a single feed, four band, PIFA in accordance with a first embodiment of the invention, this view being taken from side of the PIFA that shows the non-radiating edge of a metal radiating element.

Embodiments of PIFAs that are constructed and arranged in accordance with the present invention will now be described in detail while referring to the drawing.

Without limitation thereto, PIFAs in accordance with embodiments of the invention utilize four basic elements, i.e. (1) a generally rectangular and metal radiating element, (2) a generally rectangular, flat and metal ground plane element, (3) a coaxial feed cable having a central conductor that is connected to the radiating element, and (4) a generally rectangular/square dielectric carriage having a generally flat top surface wherein the top surface rests on four sidewalls that extend downward in a generally perpendicular direction from the top surface.

Generally, this dielectric carriage is not formed by a solid block of material. Usually the dielectric carriage comprises only four sidewalls, and a top surface is necessary if the radiating element includes a number of slots of many contours. In order to impart mechanical stability to the radiating element, and avoid sagging of the radiating element, toward the ground plane element, a top surface for the dielectric carriage is preferred.

Antenna performance is influenced by the total volume of the dielectric carriage that is under the radiating element, as well as by the dielectric constant of the material from which the dielectric carriage is formed.

The value of this dielectric constant, and the thickness of the sidewalls of the dielectric carriage that are flush with the antenna's matching stubs are important to the antenna design.

The PIFA's metal radiating element is located on a generally flat top surface of the dielectric carriage. The bottom surfaces of the four sidewalls of the dielectric carriage rest on the top surface of the PIFA's metal ground plane. These sidewalls extend generally perpendicular down with respect to the top surface of the dielectric carriage. Such an arrangement allows placement of the dielectric carriage between the radiating element and the ground plane of the PIFA.

In the following description of different embodiments of the invention, the ground plane element, the feed cable, and the dielectric carriage of PIFAs in accordance with embodiments of the invention are generally identical, and these three elements will be described only with reference to the first embodiment of the invention.

That is, the different embodiments of the invention include different constructions and arrangements of the metal radiating element that is within each PIFA in accordance with the invention, and when reference is made to certain embodiments of the invention, only the PIFA's radiating element will be described.

However, it is to be understood that all embodiments of the invention include a metal ground plane element, a feed cable, and a dielectric carriage such as is described relative to the first embodiment of the invention.

First Embodiment

A single feed, four band, PIFA 10 in accordance with a first embodiment of this invention is shown in FIGS. 1*a*, 1*b*, 1*c*, 2*a*, 2*b* and 2*c*. This first embodiment of the invention provides a single feed, four band, PIFA 10 that is responsive to the AMPS/GSM/DCS/PCS cellular bands.

PIFA 10 includes a metal radiating element 11 that is located on the generally flat top surface 12 of a carriage 13 that is formed of a dielectric (electrically insulating) material.

Figure 1B:
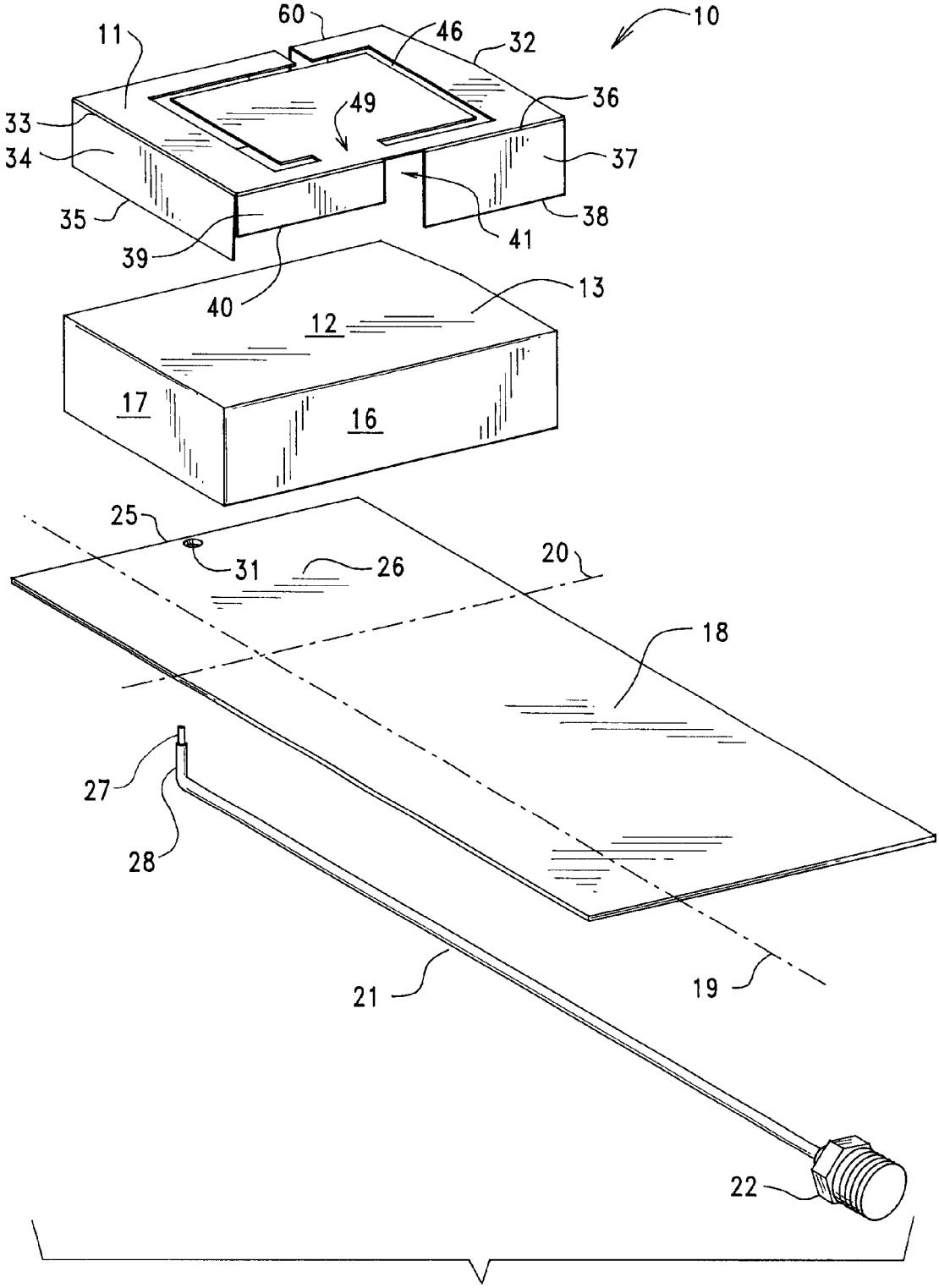
FIG. 1*b* is an exploded view of the PIFA of FIG. 1*a*, this view being taken from side of the PIFA that shows the radiating edge of the radiating element.

Dielectric carriage 13 is generally hollow, rectangular, box-like and includes a generally flat top surface 12, and a sidewall on each of the four sides of dielectric carriage 13. Two of these sidewalls 14 and 15 are shown in FIG. 1*a*, and the other two of these sidewalls 16 and 17 are shown in FIG. 1*b*. These four sidewalls 14–17 extending down generally perpendicular to the top surface of carriage 13, sidewall 14 is generally parallel to sidewall 16, and sidewall 15 is generally parallel to sidewall 17.

As will be apparent, the dielectric constant of the material from which dielectric carriage 13 is formed has an effect on the resonant characteristics of radiating element 11.

A generally flat, rectangular, and metal ground plane element 18 is carried by the bottom surfaces of the four sidewalls of carriage 13. Ground plane element 18 includes a major axis 19 that extends generally parallel to the two sidewalls 15 and 17 of dielectric carriage 13, and a minor axis 20 that extends generally parallel to the two sidewalls 14 and 16 of dielectric carriage 13.

By way of a non-limiting example, the major axis length 19 of ground plane element 18 is about 4.33 inches, the minor axis width 20 of ground plane element 18 is about 1.65 inches, and when assembled, PIFA 10 has a height (as measured generally perpendicular to ground plane element 18) of about 0.35 inch.

A coaxial cable 21 provides an electrical path for radio frequency (RF) power to be connected to radiating element 11. One end of coaxial cable 21 is terminated by a RF connector 22.

A metal conductive strip 23 that is integrally formed with and extends downward from radiating element 11 forms a feed strip for radiating element 11. Feed strip 23 extends along the sidewall 14 of dielectric carriage 13, and the end 24 of feed strip 23 is located above, but does not physically touch, ground plane 18.

Sidewall 14 of dielectric carriage 13 is located very close to the edge 25 of ground plane 18, and a feedhole 26 of suitable diameter is located under the end 24 of feed strip 23, at a position that is close to the edge 25 of ground plane element 18.

The center metal conductor 27 of RF cable 21 is inserted through feedhole 26 from the bottom surface of ground plane element 18, and is electrically isolated from ground plane 18 by way of an insulator 28. The center conductor 27 of RF cable 21 emerges out of the top surface of ground plane 18, extends through feedhole 26, and is connected to the end 24 of feed strip 23.

A metal conductive strip 29 that is integrally formed with and extends downward from radiating element 11 provides a short circuit between radiating element 11 and ground plane 18, as the end 30 of shorting strip 29 is electrically connected to ground plane element 18 at point 31.

Shorting strip 29 provides for a quarter wavelength operation of radiating element 11, and shorting strip 29 acts as a tuning element for radiating element 11 in that the physical placement of shorting strip 29 along the non-radiating edge 60 of radiating element 11 provides for an RF partitioning of radiating element 11 wherein the surface of radiating element 11 to the one side of shorting strip 29 is predominantly resonant in the lower frequency band, and the surface of radiating element 11 to the other side of shorting strip 29 is predominantly resonant in the upper frequency band.

While a generally C-shaped composite slot 46 (to be described) is shown in the top surface of radiating element 11, In the absence of such a slot on the surface of radiating element 11, shorting strip 29 controls the frequency separation that exists between the lower and the upper resonant frequency bands of radiating element 11.

Figure 1C:
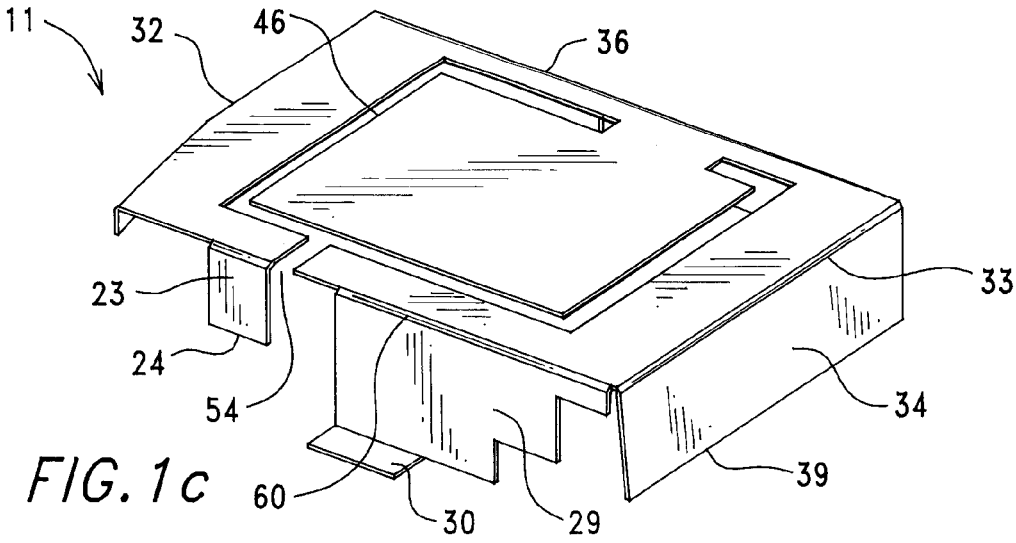
FIG. 1*c* is a perspective view showing the radiating element that is contained within FIGS. 1*a*/1*b*'s PIFA, this view showing a metal feed strip, a metal shorting strip and a metal capacitive stub that extend downward from the non-radiating edge of the radiating element.

The side edge 32 of radiating element 11 is close to feed strip 23, and as best seen in FIG. 1*b* and 1*c*, radiating element 11 is bent about 90-degrees downward along its opposite side edge 33 to form a downward extending metal plane 34. The end 35 of metal plane 34 is located above ground plane 18, and metal plane 34 forms a capacitive loading plate or capacitive stub for tuning the upper resonant frequency of radiating element 11.

The edge 36 of radiating element 11 that is located opposite to feed strip 23 and shorting strip 29 is the radiating edge of radiating element 11.

A metal conductive strip 37 (see FIG. 1*b*) is integrally formed with radiating element 11 and forms a first capacitive stub for radiating element 11 that is located along the radiating edge 36 of radiating element 11. The end 38 of capacitive stub 37 is located above ground plane 18. A second metal capacitive stub 39 (see FIG. 1*b*) is integrally formed with radiating element 11 on its radiating edge 36, and the end 40 of capacitive stub 39 is located above ground plane element 18. In general, the two capacitive stubs 37 and 39 provide a different influence on the resonance of a particular frequency band.

An open notch 41 (see FIG. 1*b*) that physically separates the two capacitive stubs 37 and 39 provides for the formation of the two capacitive tuning elements 37 and 39 on the radiating edge 36 of radiating element 11. The formation of these two capacitive tuning elements 37 and 39 provides a greater degree of freedom to control the resonance and the bandwidth characteristics of radiating element 11.

The width of capacitive stub 37 (i.e. the dimension that is measured parallel to minor axis 20 of ground plane element 18), as well as the distance between its end 38 and ground plane 18, controls the resonance and the bandwidth characteristics of radiating element 11. The width of capacitive stub 39 and the perpendicular distance between its end 40 and ground plane 18 also controls the resonance and the bandwidth characteristics of radiating element 11.

The dielectric constant of the sidewalls of the dielectric carriage is also a factor in determining the effect that the capacitive stubs have on the resonance and bandwidth.

Figure 2A:
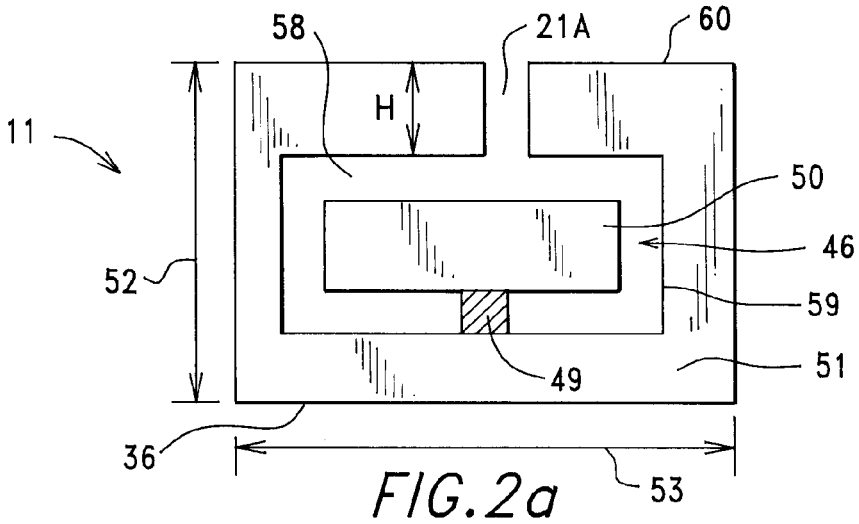
FIG. 2*a* is atop view of the radiating element of FIGS. 1*a*/1*b*'s PIFA, this figure showing that the radiating element includes a composite open slot that is formed by combining the L-shaped open slot of FIG. 2*b* with the annular open slot of FIG. 2*c*, this composite slot having an open end that is located on the non-radiating edge of the radiating element.

FIG. 2*a* shows a generally C-shaped composite slot 46 that is formed in radiating element 11. Conceptually, composite slot 46 is a combination of an L-shaped slot 47 that is shown in FIG. 2*b* and an annular slot 48 that is shown in FIG. 2*c*.

With reference to FIG. 2*a*, composite slot 46 is cut or punched into metal radiating element 11, it is generally rectangular in shape, and it has a generally uniform width of about 0.079 inch.

A metal conductive stub 49 interrupts composite slot 46 generally adjacent to radiating edge 36. Stub 49 operates to form radiating element 11 into an inner and generally rectangular-shaped metal radiating element 50, and an outer and generally C-shaped metal radiating element 51. By way of a non-limiting example, in an embodiment of the invention FIG. 2*a*'s radiating element 11 had a length 52 of about 1.18 inch and a width 53 of about 1.65 inch.

Figure 2B:
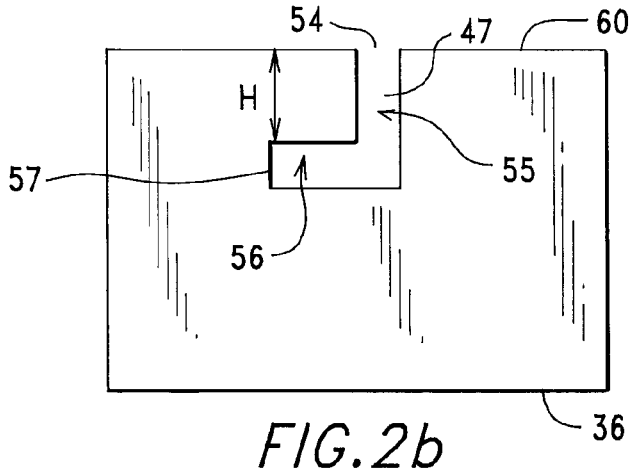
FIG. 2*b* is a top view of the radiating element of FIGS. 1*a*/1*b*'s PIFA wherein the composite slot that is contained in the radiating element, as shown in FIG. 2*a*, is conceptually shown as including an L-shaped open slot.
Figure 2C:
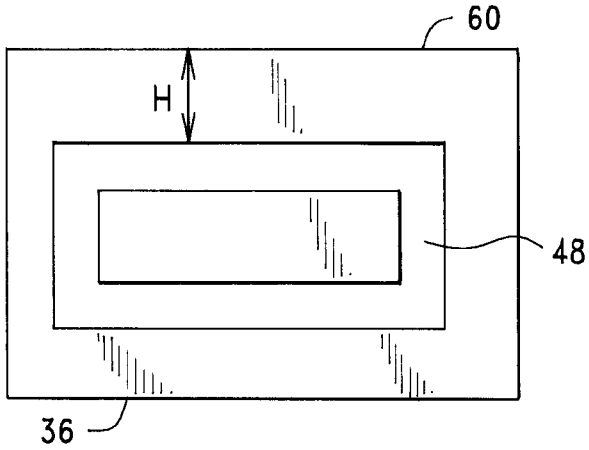
FIG. 2*c* is a top view of the radiating element of the FIGS. 1*a*/1*b* PIFA wherein the composite open slot that is contained in the radiating element, as shown in FIG. 2*a*, is conceptually shown as including an annular slot.

With reference to FIGS. 1*a*, 1*c* and 2*b*, the open end 54 of L-shaped slot portion 47 of FIG. 2*a*'s composite slot 46 is physically located between FIG. 1*b*'s shorting strip 29 and feed strip 24, such that L-shaped slot portion 47 forms a reactive loading element that reduces the resonant frequencies of the lower and the upper resonant bands of radiating element 11. Note that this effect is accomplished without increasing the physical size of radiating element 11.

The open end 54 of L-shaped slot portion 47 is located on the non-radiating edge 60 of radiating element 11. The central axis of a segment 55 of L-shaped slot 47 extends generally parallel to the major axis 19 of ground plane 18, and the central axis of a segment 56 of L-shaped slot 47 extends generally parallel to the minor axis 20 of ground plane 18 Segment 56 of L-shaped slot 47 is located at a distance "H" of about 0.16 inch from the non-radiating edge 60 of radiating element 11.

The portion of FIG. 1*a*'s composite slot 46 that comprises FIG. 2*b*'s L-shaped slot 47 having an open end 54 that is located along the non-radiating edge 60 of radiating element 11 between the radiating element's shorting strip 29 and feed strip 24, provides a wide bandwidth for the two resonant frequencies of radiating element 11, and the combined length of the slot segment 55 and the slot segment 56 that form FIG. 2*b*'s L-shaped slot 47 determines the two resonant frequencies of radiating element 11.

With reference to FIG. 2*c*, an annular slot 48 combines or merges with FIG. 2*b*'s L-shaped slot 47 to form the composite slot 46 that is shown in FIG. 2*a*, composite slot 46 being the final-form of the open slot that is shown in FIGS. 1*a*, 1*b* and 1*c*. That is, the merged or composite slot 46 that is shown in FIG. 1*a*, 1*b* and 1*c* functionally comprises (1) the L-shaped slot 46 that is shown in FIG. 2*b* merged with (2) the annular slot 48 that is shown in FIG. 2*c*.

The combination of inner metal radiating element 50 and the metal conductive stub 49 improves the bandwidth performance of radiating element 11 that can be realized in the absence of FIG. 2's annular slot 48.

The width and the position of conductive stub 49 within composite slot 46 of FIG. 2*a* can be changed in order to tune the resonant frequencies of radiating element 11.

PIFA 10 above-discussed relative to FIGS. 1*a*, 1*b*, 1*c*, 2*a*, 2*b* and 2*c* functions as a single feed, four band, PIFA. The bandwidth of single feed, four band, PIFA 10 is centered around the resonant frequencies of the lower and upper cellular bands, and is determined by the width of and the location of feed strip 23, by the width and the location of shorting strip 29, by the dielectric property of the material from which dielectric carriage 13 is formed, by the width of capacitive stub 39 and the distance between the end 40 of capacitive stub 39 and ground plane 13, by the width of capacitive stub 37 and by the distance between the end 38 of capacitive stub 37 and ground plane 18, by the linear dimensions of radiating element 11, and by the height of PIFA 10.

In general, with the placement of the L-shaped slot portion 47 of composite slot 46 between shorting strip 29 and feed strip 23, a dual resonance of radiating element 11 is provided having a much wider bandwidth, and also results in resonant bands having higher values of resonant frequencies.

Loading of radiating element 11 may be required in order to tune the resonant frequencies of PIFA 10 to the two cellular bands. Further tuning of PIFA 10 for its dual cellular resonance performance is provided through the use of FIG. 2*c*'s annular slot portion 48 that exists within FIG. 2*a*'s composite slot 46.

The combining or merging of FIG. 2*b*'s L-shaped slot portion 47 with FIG. 2*c*'s annular slot portion 48 in order to form FIG. 2*a*'s composite slot 46, and the placement of conductive stub 49 within composite slot 46, provides a two-piece composite, inner/outer, radiating element 50/51 for PIFA 10 wherein the composite radiating element 50/51 is loaded by the two slot portions 47 and 48 that make up composite slot 46. That is, a first portion of FIG. 2*a*'s composite slot 46 is confined to the one side of the central axis of the segment 55 of FIG. 2*b*'s L-shaped slot 47, and a second portion of FIG. 2*a*'s composite slot 46 is confined to the opposite side of the central axis of the segment 55 of FIG. 2*b*'s L-shaped slot 47.

As seen in FIG. 2*b*, the length of slot segment 56 defines the location of the closed end 57 of L-shaped slot 47. When compared to the total length of FIG. 2*b*'s L-shaped slot 47, the length of FIG. 2*a*'s slot segment 58 is longer, resulting in a reduction in the resonant frequencies of radiating element 11. Slot segment 58 provides a further reduction in the dual resonant frequencies of radiating element 11.

FIG. 2*a*'s slot segment 59 within composite slot 46 also provides significant reactive loading to radiating element 11, resulting in a reduction in the radiating element's dual resonant frequencies.

Depending upon the position of conductive stub 49, the relative length of FIG. 2*a*'s slot segments 58 and 59 can be varied to accomplish a desired tuning effect on the resonance characteristics of composite radiating element 11. Since the two slot segments 58 and 59 are located on opposite sides of shorting strip 29, these two slot segments 58 and 59 have significant influence in controlling the resonance of only a particular frequency band. For example, slot segment 58 has a greater influence on the lower resonant frequency band of composite radiating element 11, whereas slot segment 59 has relatively stronger influence on the control of the upper resonant frequency band.

Parameters such as the length of the segment 55 of FIG. 2*b*'s L-shaped slot 47, the width of the open end 54 of L-shaped slot 47, the length and the width of FIG. 2*a*'s slot segment 58, and the length and width of FIG. 2*a*'s slot segment 59 can be optimized to achieve a desired four band performance of PIFA 10.

Based upon the above-described first embodiment of the invention, a single feed, four band (AMPS/GSM/DCS/PCS), cellular PIFA 10 is provided.

The results of tests conducted on PIFA 10 include plots of VSWR and the impedance characteristics of PIFA 10 resonating in the dual lower cellular (AMPS/GSM) bands and the dual upper cellular (DCS/PCS) bands. The measured plot of VSWR shows satisfactory bandwidth for PIFA 10 simultaneously covering the US and European dual cellular frequency bands. These tests also illustrate that PIFA 10 provides the requisite bandwidth to cover AMPS/GSM bands at its lower resonance. Results of the VSWR plot also illustrate a satisfactory bandwidth at the upper resonance of PIFA 10 to cover DCS/PCS bands. Thus PIFA 10 demonstrates a single cellular internal antenna for the global cellular coverage.

Measured radiation patterns of PIFA 10 confirm a good gain performance of PIFA 10.

Figure 6A:
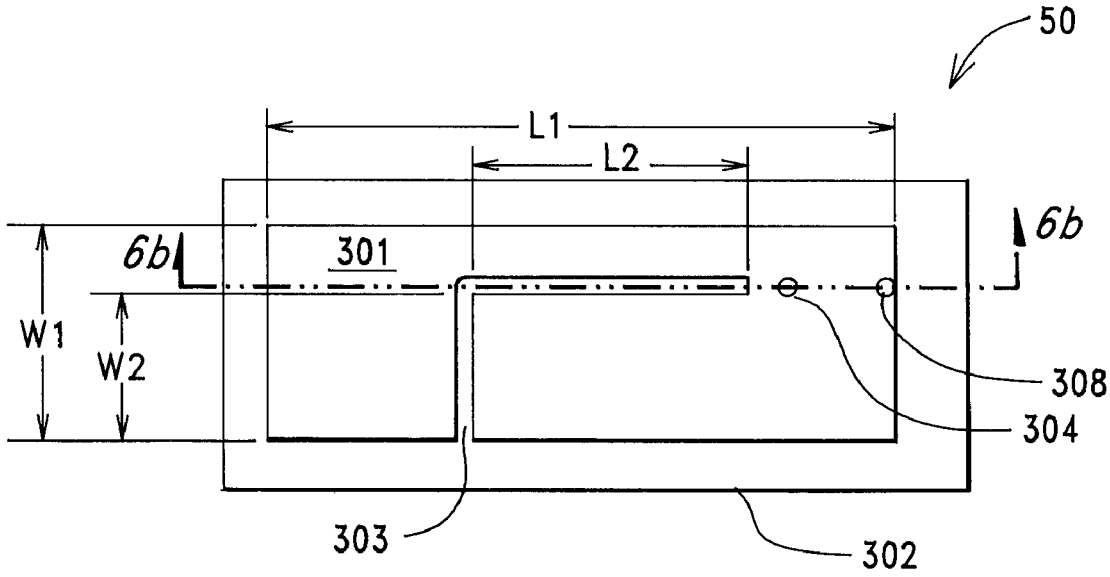
PRIOR ART FIG. 6a
FIG. 6*a* is a top view of a prior art single feed, dual band, PIFA.
Figure 6B:
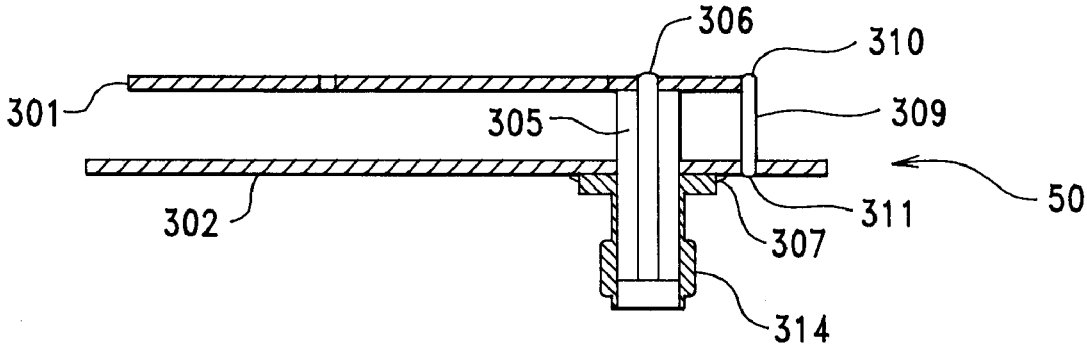
PRIOR ART FIG. 6b
FIG. 6*b* is a sectional view of the PIFA of FIG. 8a that is taken along the line 6B—6B of FIG. 6*a*.

The single feed, four band, cellular PIFA 10 of this first embodiment of the invention does not involve an increase in the overall physical size or volume of a conventional single feed, dual band, PIFA that is shown in FIGS. 6*a* and 6*b*.

The multi-part radiating element 11 of PIFA 10 can be fabricated using a process whereby a sheet of metal is stamped and then bent to form the composite radiating element shown in FIG. 1*c*, this resulting in improved manufacturability that facilitates the cost effectiveness of manufacture of PIFA 10.

Second Embodiment

Figure 3A:
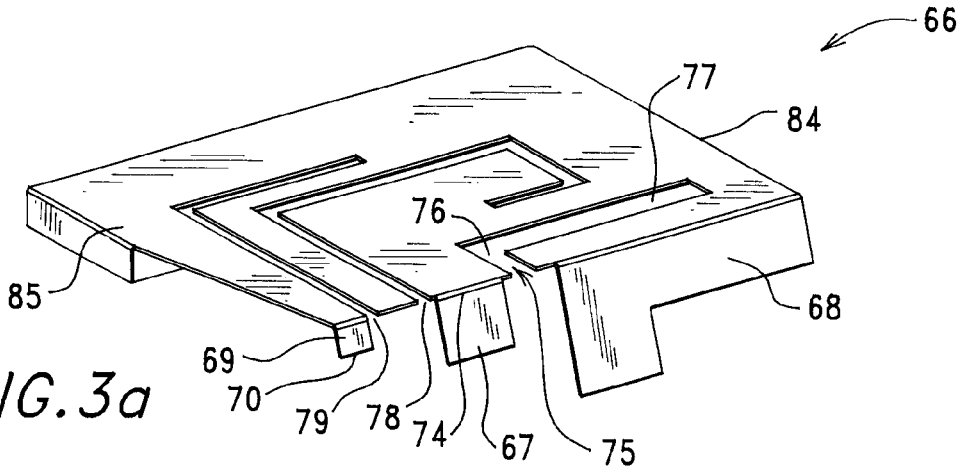
FIG. 3*a* is a top perspective view of the radiating element of a single feed, five band, PIFA in accordance with a second embodiment of the invention, this figure showing the non-radiating edge of the radiating element that includes a downward extending metal shorting strip, metal feed strip and metal capacitive stub, and this figure showing that the top surface of the radiating element includes a first generally L-shaped open slot, a generally C-shaped open slot, and a second generally L-shaped open slot, with the open ends of all three slots being located on the non-radiating edge of the radiating element.
Figure 3B:
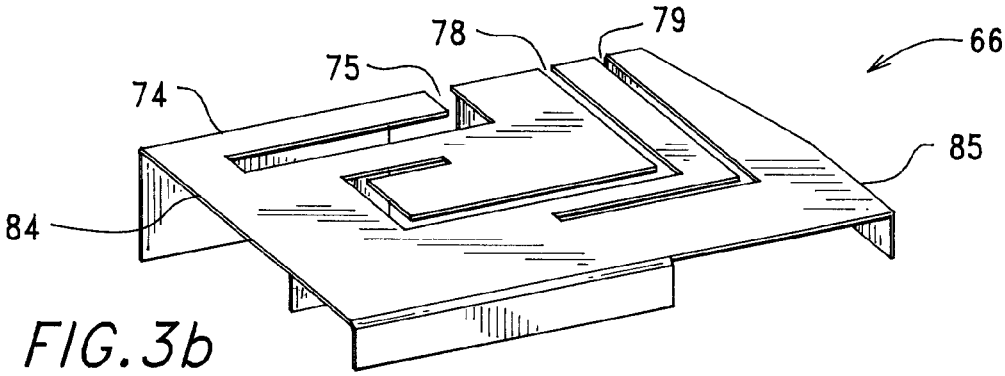
FIG. 3*b* is a top perspective view of the radiating element of FIG. 3*a*, this figure showing the radiating edge of the radiating element, and this figure showing a metal capacitive stub that extends downward from the radiating edge.
Figure 3C:
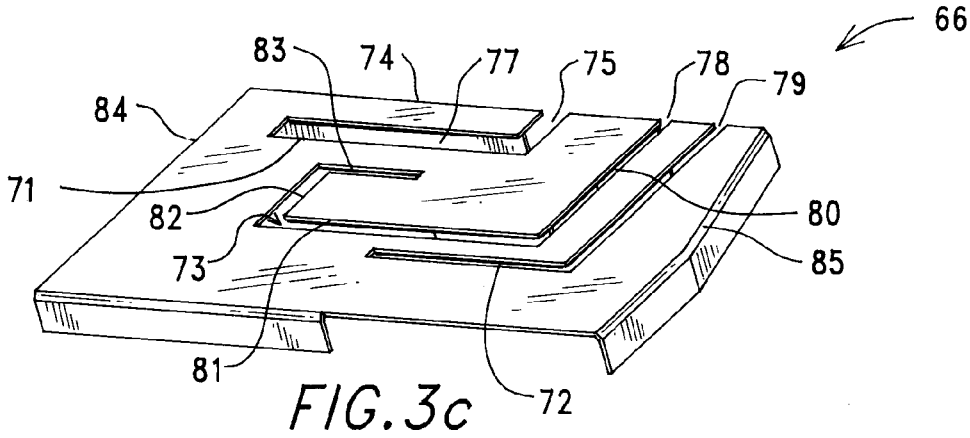
FIG. 3*c* is another top perspective view of the radiating element of FIG. 3*a* that is similar to FIG. 3*b*.

A single feed, five band (three cellular bands and two non cellular bands) PIFA in accordance with a second embodiment of this invention utilizes the metal radiating element 66 that is shown in FIGS. 3*a*, 3*b* and 3*c*. In this second embodiment of the invention the dielectric carriage, the ground plane element, and the feed cable of the single feed, five band, PIFA are as above-described relative to the first embodiment of the invention.

Metal radiating element 66 is bent downward along its non-radiating edge 74, as above-described, in order to provide a feed strip 67 and a shorting strip 68. Radiating element 66 is also bent downward along its non-radiating edge 74 to form a capacitive loading plate or stub 69, whose end 70 is located above ground plane 18, that forms a capacitive loading plate for tuning the upper resonant frequency of radiating element 66.

As perhaps best seen in FIG. 3*c*, the top surface of radiating element 66 of this single feed, five band, PIFA includes two generally L-shaped open slots 71 and 72, and a generally C-shaped open slot 73.

As shown, the open ends of all three of these slots 71, 72 and 73 are located on the non-radiating edge 74 of radiating element 66, this being the edge that also contains shorting strip 68 and feed strip 67.

As best seen in FIG. 3*a*, the open end 75 of the first L-shaped slot 71 is located between shorting strip 68 and feed strip 67, with the axis of a slot segment 76 that is within this first L-shaped slot 71 being parallel to the major axis 19 of ground plane element 18.

As was explained above relative to the first embodiment of this invention, first L-shaped slot 71 in radiating element 66 results in dual resonance with wider bandwidth around the resonant frequencies. The combined length of the slot segment 76 and the slot segment 77 that make up the first L-shaped slot 71 determines the dual resonant frequencies of radiating element 66.

A generally C-shaped slot 73 is also formed in radiating element 66. The open end 78 of C-shaped slot 73 is located between feed strip 67 and the open end 79 of the second generally L-shaped slot 72.

As seen in FIG. 3*c*, C-shaped slot 73 includes a first slot segment 80, a second slot segment 81 that extends generally perpendicular to first slot segment 80, a third slot segment 82 that extends generally parallel to first slot segment 80, and a fourth slot segment 83 that extends generally parallel to second slot segment 81.

The open end 79 of the second L-shaped slot 72 is located between the open end 78 of C-shaped slot 73 and the edge 85 of radiating element 66.

The above-mentioned conductive metal stub 69 (i.e. a capacitive matching stub) is attached to the non-radiating edge 74 of radiating element 66, and extends generally flush with the outer surface of the sidewall 14 of dielectric carriage 13. Matching stub 69 covers that portion of the non-radiating edge 74 of radiating element 66 that lies between the edge 85 of radiating element 66 and the open end 79 of L-shaped slot 72. One end of matching stub 69 is formed integrally with radiating element 66 and the other end of matching stub 69 is located above ground plane 18.

Matching stub 69 forms a capacitive tuning element that controls the resonance and the bandwidth characteristics of the upper frequency band of the FIG. 3*a*/3*b*/3*c*'s radiating element 66.

The PIFA of this second embodiment of the invention, which includes radiating element 66 shown in FIGS. 3*a*/3*b*/3*c*, functions as a single feed, five band (three cellular bands and two non cellular bands), PIFA.

The bandwidth of the single feed, five band, PIFA centered around the resonant frequencies of the lower and the upper cellular frequency bands is determined by; (1) the location and the width of feed strip 67, (2) the location and the width of shorting strip 68, (3) the dielectric constant of the material that comprises dielectric carriage 12, (4) the linear dimensions of radiating element 66, and (5) the height of the PIFA.

In general, with the placement of the open end 75 of L-shaped slot 72 between shorting strip 68 and feed strip 67, dual resonance is provided having a much wider bandwidth, and also results in resonant frequency bands having higher values of resonant frequencies.

Reactive loading of radiating element 66 allows tuning the resonant frequencies of the PIFA to the two cellular bands. Further tuning of the PIFA for its resonance in three cellular and two non-cellular bands is provided by the L-shaped slot 71 and by the C-shaped slot 73.

When the profile of C-shaped slot 73 comprises only its two slot segment 80 and 81, the PIFA provides three cellular band performance. When the effective length of C-shaped slot 73 is increased by including its two additional slot segments 82 and 83, two resonant frequencies of the PIFA are reduced, with an additional resonance frequency being a near-non-cellular (GPS) frequency band.

If necessary, the two cellular resonant frequencies of the PIFA can be retuned by altering the distances between the radiating element's various downward extending metal planes and ground plane 18. Also, the two cellular resonant frequencies of the PIFA can be retuned by modifying the length of the slot segment 77 that is within L-shaped slot 71.

Thus, the combination of a first L-shaped slot 71 and a C-shaped slot 73 provides for the three resonant frequency bands, i.e. two cellular bands and one non cellular band, and the second L-shaped slot 72 provides an additional non cellular frequency resonance that supplements the triple resonance of the PIFA.

The second L-shaped slot 72 has a minor effect on the triple resonance of the PIFA. However, L-shaped slot 72 provides the desirable advantage of an additional resonance near the upper non cellular frequency band (ISM or BT).

Minor deviations in the two cellular resonant and the lower non-cellular resonance characteristics of the PIFA can be re optimized through the design parameters that control them. Thus, with the sequential introduction of multiple slots at desired locations on radiating element 66 the PIFA of the second embodiment of the invention enhances the dual resonant frequency operation of a single feed PIFA to that of four resonant frequencies of operation.

It is pertinent to point that as design progresses to enhance the number of realizable resonant bands, an iterative technique may be required to offset any minor undesirable variations in the prior resonant characteristics of the five band PIFA.

Invoking concepts provided by the FIG. 3*a*/3*b*/3*c* of second embodiment of the invention, a single feed, five band (AMPS/DCS/PCS/GPS/ISM) PIFA for three cellular and two non-cellular applications is provided.

Tests conducted on the single feed, five band, PIFA show satisfactory bandwidth for the five band operation of the PIFA covering simultaneously the three cellular frequency bands (AMPS/DCS/PCS) and two non non-cellular frequency bands (GPS/ISM). The simultaneous realization of four distinct resonant frequencies in AMPS, GPS, DCS/PCS and ISM bands is also demonstrated by these tests.

The requisite bandwidth for the five-band operation of the PIFA is achieved through optimization of the bandwidth around the individual resonant frequencies. Satisfactory gain performance of the PIFA in all five bands has been verified by measurement of the radiation patterns of the single feed, five band, PIFA.

Similar to PIFA 10 of first embodiment of the invention, the single feed, five band, PIFA of the second embodiment of this invention, also provides the desirable feature of overcoming the enormity of the bandwidth requirement around any specific resonant frequency to cover three cellular frequency bands and two non-cellular frequency bands.

The PIFA of this second embodiment of the invention, having five band operation, is a modification of a single feed, two band, PIFA structure. However, the single feed, five band, PIFA does not require an increase in the overall physical size or volume of a single feed, two band. PIFA.

Radiating element 66 having three slots and various downward extending metal planes can be provided using a single piece of metal that is cut or punched, and then bent, thus resulting in an improved method of making radiation element 66. As mentioned relative to the first embodiment of this invention, this cut/bend process of forming radiation element 66 provides a relative easy and cost effective means by which the PIFA is fabricated.

Third Embodiment

Figure 4A:
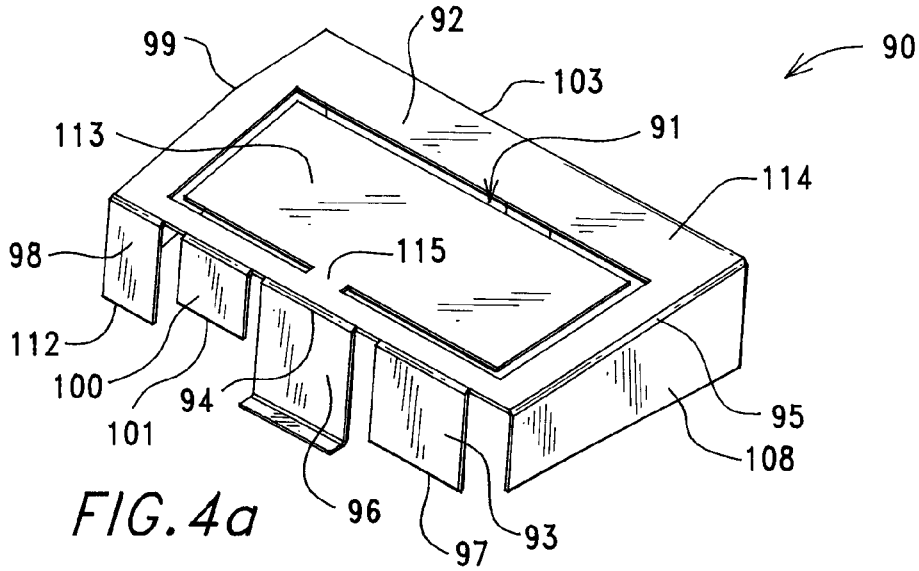
FIG. 4*a* is a top perspective view of the radiating element of a single feed, three band, PIFA in accordance with a third embodiment of the invention, this figure showing the non-radiating edge of the radiating element and a metal shorting strip, feed strip and two capacitive stubs that extend downward from the non-radiating edge, and this figure showing that the top surface of the radiating element includes a generally C-shaped annular slot that partitions the radiating element into a generally rectangular outer radiating element and a generally C-shaped inner radiating element.
Figure 4B:
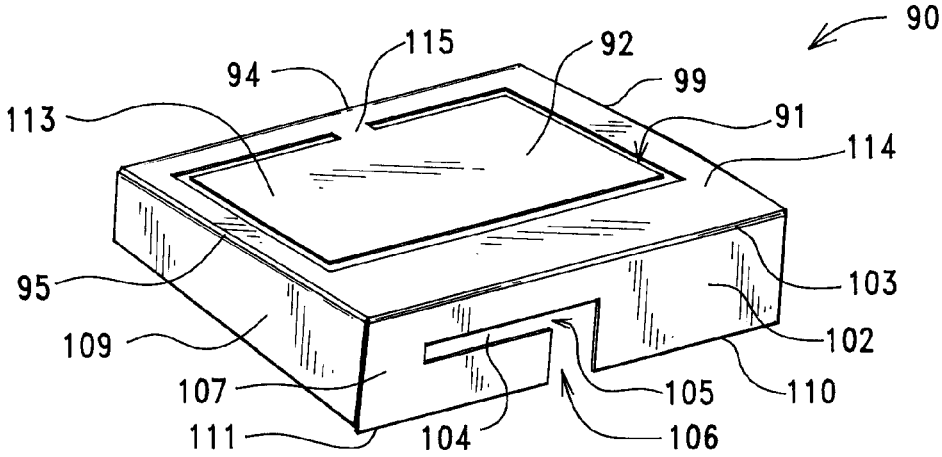
FIG. 4*b* is a top perspective view of the radiating element of FIG. 4*a*, this figure showing the radiating edge of the radiating element, and this figure showing that the radiating edge includes two downward extending capacitive stubs that are separated by an open notch, with one of the two capacitive stubs including an open slot that extends generally parallel to the radiating edge.

A single feed, three band (two cellular bands and one non cellular band) PIFA in accordance with a third embodiment of this invention utilizes the metal radiating element 90 that is shown in FIGS. 4*a* and 4*b*. In this third embodiment of the invention the dielectric carriage, the ground plane element, and the feed cable of the single feed, three band, PIFA are as above-described relative to the first embodiment of the invention.

This third embodiment of the invention provides a single feed, three band, PIFA that is responsive to the AMPS/PCS or the GSM/DCS cellular bands and the GPS or the ISM non-cellular band.

The single feed, three band, PIFA of the third embodiment of the invention resembles the single feed, four band, PIFA of FIGS. 1*a* and 1*b*, with the following distinctions. The single feed, three band, PIFA of the third embodiment of this invention provides a generally C-shaped slot 91 on the top and generally flat surface 92 of radiating element 90. C-shaped slot 91 is realized by placement of conductive stub 115 within the contour of annular slot 91.

As seen in FIG. 4*a*, a metal conductive stub 93 extends downward from the non-radiating edge 94 of radiating element 90, generally flush with the outer surface of the sidewall 14 of dielectric carriage 13. Conductive stub 93 covers that portion of the non-radiating edge 94 of radiating element 90 that is contained between the side edge 95 of radiating element 90 and a metal shorting strip 96 whose free end is connected to ground plane element 18.

The end 97 of conductive stub 93 is spaced from ground plane 18, and conductive stub 93 forms a capacitive tuning element that controls the resonant frequency of the lower band of radiating element 90 of the PIFA of this third embodiment of the invention.

A metal conductive stub 98 also extends downward from the non-radiating edge 94 of radiating element 90. Conductive stub 98 is also located generally flush with the surface of the sidewall 14 of dielectric carriage 13, and conductive stub 98 covers that portion of the non-radiating edge 94 of radiating element 90 that is contained between the side edge 99 of radiating element 90 and a metal feed strip 100 that is connected to the center conductor 27 of feed cable 21.

The end 112 of conductive stub 98 is spaced above ground plane 18, and conductive stub 98 operates as a tuning element that controls the resonant frequency of the upper band of the radiating element 90 that is within the PIFA of this third embodiment of the invention.

With reference to FIG. 4*b*, a first metal capacitive stub 102 and a second metal capacitive stub 107 are attached to the radiating edge 103 of radiating element 90.

Capacitive stub 107 includes an open slot 104 that extends generally parallel to radiating edge 103 and to minor axis 20 of ground plane element 18. The open end 105 of slot 104 faces an open notch 106 that separates the two capacitive tuning stubs 102 and 107. Slot 104 provides a reactive loading that reduces the resonant frequencies of radiating element 90. Therefore, length of slot 104 (as measured parallel to radiating edge 103) enables variation in the resonant frequencies of radiating element 90 that is within the PIFA of this third embodiment of the invention.

The PIFA in accordance with the third embodiment of the invention that includes radiating element 90 functions as a single feed, three bands (two cellular bands and one non cellular band) PIFA. The bandwidth of this PIFA centered around the resonant frequencies of the lower and upper cellular frequency bands is determined by; (1) the width and the location of feed strip 100, (2) the width and the location of shorting strip 96, (3) the dielectric constant of the material from which dielectric carriage 13 is made, (4) the width of capacitive stub 102 and the distance between the end 110 of stub 102 and ground plane element 18, (5) the Width of capacitive stub 107 and the distance between the end 111 of stub 107 and ground plane element 18, (6) the length of slot 104, (7) the width and the position of matching stub 93, (8) the distance between the end 97 of matching stub 93 and ground plane element 18, (9) the width and the position of matching stub 98, (10) the distance between the end 112 of matching stub 98 and ground plane element 18, (11) the linear dimensions of radiating element 90, and (12) the height of the PIFA that contains radiating element 90.

Using a combination of the above-listed parameters, the two cellular resonance of the radiating element 90 and its PIFA is realized by optimizing the above parameters.

Tuning this PIFA for its resonance in a non-cellular frequency band is provided by the generally C-shaped slot 91 that is within the top surface 92 of radiating element 90. Slot 91 provides an inner radiating element 113 that is separated from an outer or main radiating element 114 by slot 91. A metal conductive stub 115 that is located adjacent to non-radiating edge 94 connects inner radiating element 113 to outer radiating element 114. Inner radiating element 113 and connecting stub 115 serve as an additional antenna whose dimensions are optimized to accomplish additional resonance of the PIFA in a non-cellular frequency band.

The dimensions of inner radiating element 113, which depend upon the profile and the contour of C-shaped slot 91, primarily determine the non-cellular resonant frequency of the PIFA. The size and position of conductive stub 115 are additional tuning parameters that control the resonance of the PIFA in the non-cellular frequency band.

Any detuning that is noticed in the two cellular band resonance characteristics of radiating element 90 as a result of the presence of C-shaped slot 91 can be adjusted by re optimizing the design parameters that control the resonance of the two cellular bands.

A configuration of a PIFA to provide three band operation in two cellular bands and one non cellular band in accordance with this third embodiment of the invention does not result in an increase in the overall physical size or volume of a single, two band, PIFA as shown in FIGS. 6*a* and 6*b*.

Radiating element 90 can be made by a process of cutting and then bending of a single sheet of metal, this resulting in improved manufacturability that facilitates a relative easy and cost effective means of fabricating radiating element 90.

The single feed, three band, PIFA in accordance with the third embodiment of this invention provides for two distinct resonant frequencies in the two cellular bands AMPS/PCS or GSM/DCS, and one in non-cellular GPS or ISM band. The single feed, three band, PIFA of this third embodiment of the invention also provides the desirable feature of overcoming the enormity of the bandwidth requirement centered around any specific resonant frequency for a three band operation involving two cellular and one non-cellular frequency band.

Fourth Embodiment

Figure 5A:
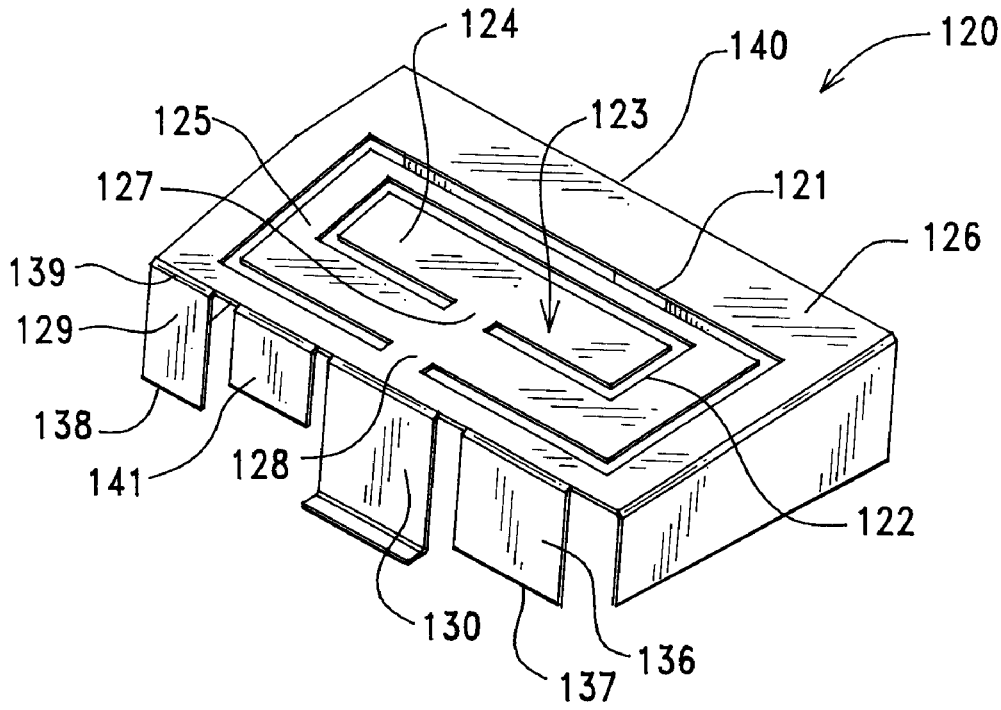
Figure 5B:
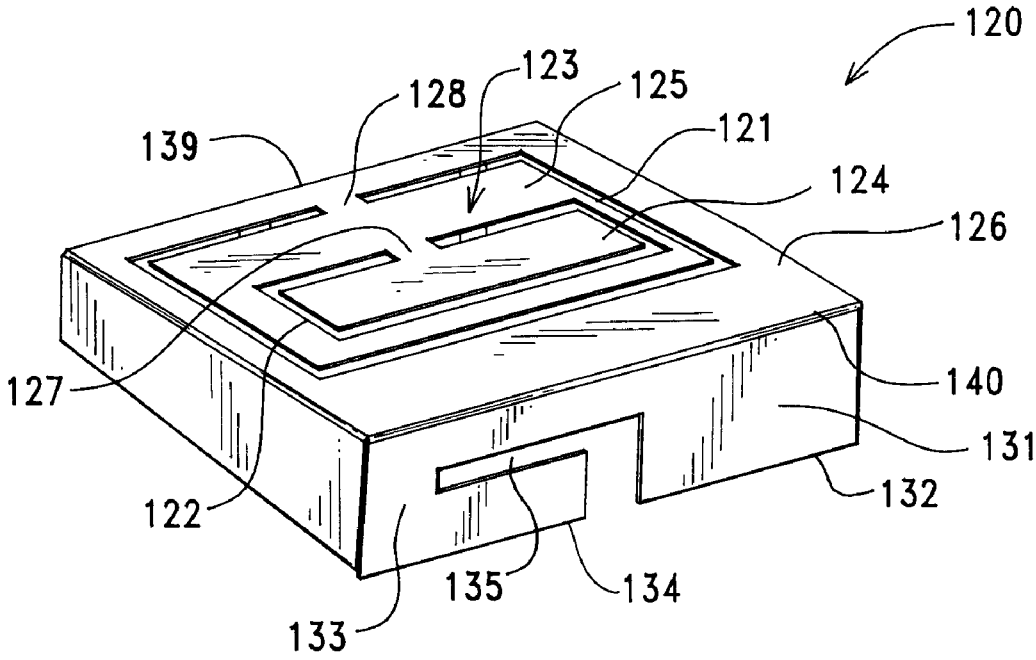

A single feed, four band (two cellular bands and two non cellular bands) PIFA in accordance with a fourth embodiment of this invention utilizes the metal radiating element 120 that is shown in FIGS. 5*a* and 5*b*. In this fourth embodiment of the invention the dielectric carriage, the ground plane element, and the feed cable of the single feed, three band, PIFA are as above-described relative to the first embodiment of the invention.

The single feed, four band, PIFA of the fourth embodiment of the invention resembles the single feed, four band, PIFA of FIGS. 1*a* and 1*b*, with the following distinctions. The single feed, four band, PIFA of the fourth embodiment of this invention provides two generally annular slots 121 and 122 on the top and generally flat surface 123 of radiating element 120.

Placement of conductive stub 128 within the contour of outer annular slot 121 modifies annular slot 121 to a generally C-shaped slot 121. Similarly, placement of conductive stub 127 within the contour of inner annular slot 122 modifies annular slot 122 to a generally C-shaped slot 122.

As shown in FIGS. 5*a* and 5*b*, C-shaped slot 122 is encompassed within C-shape d slot 121, and the two C-shaped slots 121 and 122 divide the top surface 123 of radiating element 120 into a generally rectangular outer radiating element 126, a generally C-shaped middle (first inner) radiating element 125, and a generally C-shaped second inner radiating element 124.

A first conductive stub 127 within C-shaped slot 122 is located generally adjacent to the non-radiating edge 139 of radiating element 120 and operates to connect the second inner radiating element 124 to the middle (first inner) radiating element 125, and a second conductive stub 128 operates to connect the middle radiating element 125 to the outer radiating element 126.

Outer radiating element 126 provides for a first and a third resonance to the PIFA of this fourth embodiment of the invention, wherein the first resonance corresponds to the lower cellular band (AMPS or GSM), and the third resonance corresponds to the upper cellular band (PCS or DCS).

A second resonance of a PIFA that includes radiating element 120 is provided by the outermost C-shaped slot 121 that is formed in the top surface 123 of radiating element 120. This second resonance provides for operation in the lower non-cellular frequency and (GPS).

The means of providing the above-described first, second and third resonance frequencies of the PIFA of this fourth embodiment of the invention is generally identical to that above-described PIFA of the third embodiment of this invention.

The resonance of a PIFA in accordance with this fourth embodiment of the invention in the upper non-cellular frequency band is provided by the second or innermost C-shaped slot 122. The linear dimensions of the second inner radiating element 124 primarily determine the fourth resonant frequency of the PIFA, and this fourth resonant frequency is adjusted for the upper non-cellular resonant band.

Apart from the linear dimensions of the second inner radiating element 124, the position and the size of conductive stub 127 constitutes a parameter that operates to vary and control the upper non-cellular resonance of a PIFA in accordance with this fourth embodiment of the invention.

Other portions of radiating element 120, including metal plates that extend downward from it radiating edge 140, are generally identical to radiating element 90 of FIGS. 4*a* and 4*b*, and further description of radiating element 120 illustrated in FIGS. 5*a* and 5*b* will not be given to avoid repetition.

A PIFA in accordance with this fourth embodiment of the invention that includes the radiating element 120 illustrated in FIGS. 5*a* and 5*b* functions as a single feed, four band (two cellular bands and two non-cellular bands) PIFA.

The bandwidth of such a single feed, four band, PIFA centered around the resonant frequencies of the lower and upper cellular frequency bands is determined by; (1) the location and width of metal feed strip 141, (2) the location and the width of metal shorting strip 130, (3) the dielectric constant of the material from which dielectric carriage 13 is made, (4) the width of stub 131 and the distance between the end 132 of stub 131 and ground plane 18, (5) the width of metal stub 133 and the distance between the end 134 of stub 133 and ground plane 18, (6) the length of the slot 135 that is within stub 133, (7) the position and the width of matching stub 136, (8) the distance between the end 137 of matching stub 136 and ground plane element 18, (9) the position and the width of matching stub 129, (10) and the distance between the end 138 of matching stub 129 and ground plane element 18, (11) the linear dimensions of radiating element 120, and (12) the height of the PIFA the includes radiating element 120.

Using a combination of the above-described parameters, the dual cellular resonance of the PIFA's radiating element 120 is realized.

Resonance of radiating element 120 in the upper non-cellular frequency band is provided by C-shaped slot 122, wherein with the formation of C-shaped slot 122 on radiating element 120 the second inner radiating element is formed.

Middle radiating element 125 and connecting stub 128 provide an additional antenna whose dimensions are optimized to provide resonance in a lower non-cellular frequency band. In effect, conductive stub 128 couples together a dual cellular resonance of radiating element 120 that would be provided in the absence of C-shaped slot 121 and the non-cellular resonance of the middle radiating element 125 that is formed by C-shaped slot 121.

The dimensions of middle radiating element 125, which depend on the profile and the contour of the two C-shaped slots 121 and 122, primarily determine the lower non-cellular resonant frequency of the PIFA. The size and the position of conductive stub 128 are additional tuning parameters that control resonance of the PIFA in a lower noncellular frequency band.

C-shaped slot 122 may cause a minor detuning of the dual cellular resonance characteristics of the PIFA's radiating element 120. Such a detuned dual cellular response of radiating element 120 can be adjusted by re optimizing the design parameters that control the dual cellular resonance of radiating element 120.

Resonance of a PIFA in accordance with this fourth embodiment of the invention in the upper non-cellular frequency band is provided by the C-shaped slot 122, wherein C-shaped slot 122 forms the second inner radiating element 124.

Second inner radiating element 124 and its connecting stub 127 provides an antenna element whose dimensions are optimized for the resonance in upper non-cellular frequency band.

In effect, conductive stub 127 couples together a triple resonance of radiating element 120 that would be provided in the absence of C-shaped slot 122 with the resonance of the inner radiating element 124 that is formed by C-shaped slot 122.

The dimensions of second inner radiating element 124, which in turn depends upon the profile and the contour of C-shaped slot 122, primarily determine the fourth resonant frequency of the PIFA. The size and the position of conductive stub 127 are additional tuning parameters that control the resonance of the PIFA in the upper non-cellular frequency band.

The use of C-shaped slot 122 may cause small deviations or detuning to the dual cellular resonance characteristics of the radiating element 120. This detuned dual cellular response of radiating element 120 can be re adjusted by re optimizing the design parameters that influence the dual cellular resonance of radiating element 120.

Radiating element 120, having the two C-shaped slots 121 and 122, can be made by way of a process of cutting and bending of a single sheet of metal, thus resulting in a method of manufacture that is relative easy to perform and is cost effective.

The single feed, four band, PIFA of the fourth embodiment of this invention provides four distinct resonant frequencies in two cellular bands (AMPS/PCS or GSM/DCS) bands, and in two non-cellular bands (GPS/ISM).

As with previous embodiments of this invention, this single feed, four band, PIFA circumvents the enormity of a bandwidth requirement that is centered on any specific resonant frequency for the four band operation that is involving in the two cellular frequency bands and the two non-cellular frequency bands.

Similarly, re-optimization of first C-shaped slot 121 may be required to compensate for detuning in the lower non-cellular resonant frequency band of the PIFA that may be caused by the presence of the second C-shaped slot 122.

As with the above-described third embodiment of this invention, a PIFA in accordance with this fourth embodiment of the invention, wherein four band (two cellular bands and two non-cellular bands) band PIFA operation is provided, involves only simple modifications to a single feed, dual band, PIFA of FIGS. 6*a* and 6*b*. The modifications that are provided for the radiating element 120 of the fourth embodiment of this invention provide a single feed, four band (two cellular and two non-cellular), PIFA without increasing in the overall physical size or volume of a single feed, two band, PIFA.

SUMMARY OF DETAILED DESCRIPTION

As can be seen from the above detailed description, embodiments of this invention provide single feed, three band, four band and five band PIFAs wherein the invention effectively circumvents the enormity of the combined bandwidth requirement around any specific resonant frequency, wherein the invention provides for operation of the PIFAs in both cellular and non-cellular frequency bands, and wherein PIFAs in accordance with the invention do not require an increase in the overall volume or size of a prior art single feed, two band, PIFAs, thereby accomplishing a miniaturization of the size of the PIFA when function is considered.

Embodiments of the invention utilize open or closed slots within the PIFA's radiating element in order to provide resonance in both cellular and non-cellular frequency bands, the PIFA's radiating element including a shorting strip, a feed strip, and tuning stubs, either matching or capacitive, and wherein the radiating element is formed by way of the cutting and bending of a single sheet of metal.

The use of slot loading and capacitive loading of the PIFA's radiating element as provided by this invention achieves a reduction in the resonant frequency of a PIFA without increasing the size of the PIFA. The present invention's use of the physical position of a shorting strip as a tuning element is an additional feature of this invention, and the single feed, three band, four band and five band, PIFAs of this invention are lightweight, compact, cost-effective and easy to manufacture.

The above-described use of open or closed slots within the radiating element of a single feed, multi band, PIFA in accordance with this invention provides for Global Cellular Coverage and non-cellular (GPS or BT) coverage.

While the invention had been described while making detailed reference to various embodiments of the invention, it is known that those skilled in the art will, when learning of this invention, readily visualize yet other embodiments that are within the spirit and scope of the invention. Thus, this detailed description is not to be taken as a limitation on the spirit and scope of the invention.

What is claimed is:

1. A method of providing a PIFA having a single feed and having more than two frequency bands of resonance, comprising the steps of:

providing a dielectric carriage having a top surface and sidewalls that extend generally perpendicular from said top surface, a bottom of said sidewalls defining a bottom surface that is generally parallel to said top surface;

providing a metal ground plane element on said bottom surface;

providing a metal radiating element on said top surface;

said radiating element having a radiating edge and a non-radiating edge;

providing a metal shorting strip on said non-radiating edge of said radiating element that extends downward from said radiating element and is electrically connected to said ground plane element;

providing a metal feed strip on said non-radiating edge of said radiating element that extends downward from said radiating element and has a free end that is spaced above said ground plane element;

providing a feed cable;

connecting said feed cable to said free end of said feed strip;

providing a slot configuration in said metal radiating element;

providing downward extending metal plates on said metal radiating element;

said downward extending metal plates having free ends that are spaced above said ground plane element; and configuring said slot configuration and said downward extending metal plates to provide said more than two frequency bands of resonance.

2. The method of claim 1 wherein said downward extending metal plates are closely associated with said sidewalls of said dielectric carriage.

3. The method of claim 2 wherein said more than two frequency bands are selected from the group three, four or five frequency bands.

4. The method of claim 1 wherein said metal radiating element is formed by the steps of:

providing a generally flat sheet of metal;

punching/cutting said generally flat sheet of metal to form said slot configuration and outward extending metal plates in said generally flat metal sheet; and bending said outward extending metal plates downward to form said downward extending metal plates on said metal radiating element.

5. The method of claim 1 wherein said more than two frequency bands comprise four frequency bands, and including the step of:

providing said slot configuration as a generally C-shaped slot that is interrupted by a conductive metal stub that is located adjacent to said radiating edge of said radiating element;

said generally C-shaped slot forming said radiating element into an inner radiating element and an outer radiating element that is electrically connected to said inner radiating element by said conductive metal stub; and providing a slot on said non-radiating edge of said radiating element in a location that is between said shorting strip and said feed strip.

6. The method of claim 5 wherein said generally C-shaped slot includes:

a first slot portion that extends from one side of said conductive metal stub generally parallel to said non-radiating edge;

a second slot portion that extends from said first slot portion generally perpendicular to said non-radiating edge;

a third slot portion that extends from said second slot portion generally parallel to said non-radiating edge;

a fourth slot portion that extends from said third slot portion generally perpendicular to said non-radiating edge; and a fifth slot portion that extends from said fourth slot portion generally parallel to said non-radiating edge to an opposite side of said conductive metal stub.

7. The method of claim 6 wherein said slot connects to said third slot portion of said generally C-shaped slot.

8. The method of claim 7 wherein said downward extending metal plates are closely associated with said sidewalls.

9. The method of claim 8 wherein said metal radiating element is formed by the steps of:

providing a generally flat sheet of metal;

punching/cutting said generally flat sheet of metal to form said generally C-shaped slot, said conductive metal stub, said slot and said outward extending metal plates in said generally flat metal sheet; and bending said outward extending metal plates downward to form said downward extending metal plates on said metal radiating element.

10. The method of claim 1 wherein said more than two frequency bands comprise four frequency bands, and including the step of:

providing said slot configuration as a first generally C-shaped slot that is interrupted by a first conductive metal stub located adjacent to said non-radiating edge, and a second generally C-shaped slot that surrounds said first generally C-shaped slot and is interrupted by a second conductive metal stub located adjacent to said non-radiating edge;

said first generally C-shaped slot forming a inner radiating element;

said second generally C-shaped slot forming a middle radiating element that is connected to said inner radiating element by said first conductive metal stub; and said second generally C-shaped slot forming an outer radiating element that is electrically connected to said middle radiating element by said second conductive metal stub.

11. The method of claim 10 wherein said metal radiating element is formed by he steps of:

providing a generally flat sheet of metal;

punching/cutting said generally flat sheet of metal to form said first and second generally C-shaped slots, said first and second conductive metal stubs and said outward extending metal plates in said generally flat metal sheet; and bending said outward extending metal plates downward to form said downward extending metal plates on said metal radiating element.

12. The method of claim 10 wherein:

said first generally C-shaped slot includes a first slot portion extending from one side of said first conductive stub generally parallel to said non-radiating edge, a second slot portion extending from said first slot portion generally perpendicular to said non-radiating edge, a third slot portion extending from said second slot portion generally parallel to said non-radiating edge, a fourth slot portion extending from said third slot portion generally perpendicular to said non-radiating edge, and a fifth slot portion extending from said fourth slot portion generally parallel to said non-radiating edge to an opposite side of said first conductive stub; and said second generally C-shaped slot includes a first slot portion extending from one side of said second conductive stub generally parallel to said non-radiating edge, a second slot portion extending from said first slot portion generally perpendicular to said non-radiating edge, a third slot portion extending from said second slot portion generally parallel to said non-radiating edge, a fourth slot portion extending from said third slot portion generally perpendicular to said non-radiating edge, and a fifth slot portion extending from said fourth slot portion generally parallel to said non-radiating edge to an opposite side of said second conductive stub.

13. The method of claim 12 wherein said downward extending metal plates are closely associated with said sidewalls of said dielectric carriage.

14. The method of claim 1 wherein said more than two frequency bands comprise five frequency bands, and including the step of:

providing said slot configuration as a first generally L-shaped slot having an end that is located on said non-radiating edge intermediate said shorting strip and said feed strip, a second generally L-shaped slot having an end located on said non-radiating edge, and a third slot that is located intermediate said first and second generally L-shaped slots having an end that is located on said non-radiating edge intermediate said ends of said first and second generally L-shaped slots.

15. The method of claim 14 wherein said metal radiating element is formed by the steps of:

providing a generally flat sheet of metal;

punching/cutting said generally flat sheet of metal to form said first and second generally L-shaped slots, said third slot and said outward extending metal plates in said generally flat metal sheet; and bending said outward extending metal plates downward to form said downward extending metal plates on said metal radiating element.

16. The method of claim 14 wherein:

said first and second generally L-shaped slots include a first slot portion extending generally perpendicular from said non-radiating edge, and a second slot portion extending from said first slot portion generally parallel to said non-radiating edge; and said third slot includes a first slot portion extending generally perpendicular from said non-radiating edge, a second slot portion extending from said first slot portion generally parallel to said non-radiating edge, a third slot portion extending from said second slot portion generally perpendicular to said non-radiating edge, and a fourth slot portion extending from said third slot portion generally parallel to said non-radiating edge.

17. The method of claim 16 wherein said downward extending metal plates are closely associated with said sidewalls of said dielectric carriage.

18. The method of claim 1 wherein said more than two frequency bands comprise three frequency bands, and including the step of:

providing said slot configuration as a generally C-shaped slot that is interrupted by a conductive metal stub that is located adjacent to said non-radiating edge of said radiating element;

said generally C-shaped slot forming said radiating element into an inner radiating element and an outer radiating element that is electrically connected to said inner radiating element by said conductive metal stub;

providing a downward extending plate on said radiating edge of said radiating element; and providing a generally L-shaped slot in said downward extending plate;

said generally L-shaped slot having an open end located adjacent to said ground plane element.

19. The method of claim 18 wherein;

said generally C-shaped slot includes a first slot portion extending from one side of said conductive stub generally parallel to said non-radiating edge, a second slot portion extending from said first slot portion generally perpendicular to said non-radiating edge, a third slot portion extending from said second slot portion generally parallel to said non-radiating edge, a fourth slot portion extending from said third slot portion generally perpendicular to said non-radiating edge, and a fifth slot portion extending from said fourth slot portion generally parallel to said non-radiating edge to an opposite side of said conductive stub; and said L-shaped slot includes a first slot portion that extends from said end generally perpendicular to said radiating edge, and a second slot portion extending from said first slot portion generally parallel to said radiating edge.

20. The method of claim 19 wherein said downward extending metal plates are closely associated with said sidewalls of said dielectric carriage.

21. The method of claim 18 wherein said metal radiating element is formed by the steps of:

providing a generally flat sheet of metal;

punching/cutting said generally flat sheet of metal to form said generally C-shaped slot, said conductive metal stub and said generally L-shaped slot in said generally flat metal sheet; and bending said outward extending metal plates downward to form said downward extending metal plates on said metal radiating element.

22. A PIFA having a single feed and having more than two frequency bands of resonance, comprising:

a dielectric carriage having a top surface and sidewalls that extend downward from said top surface, a bottom of said sidewalls defining a bottom surface;

a metal ground plane element generally abutting said bottom surface;

a metal radiating element generally abutting said top surface;

said radiating element having a radiating edge and a non-radiating edge;

a metal shorting strip extending downward from said non-radiating edge and electrically connected to said ground plane element;

a metal feed strip extending downward from said non-radiating edge and having a free end spaced from said ground plane element;

a feed cable connected to said free end of said feed strip;

metal plates extending downward from said radiating element in a generally abutting relationship with said sidewalls; and said metal plates having free ends that are spaced from said ground plane element.

23. The PIFA of claim 22 wherein said more than two frequency bands are selected from the group three, four or five frequency bands.

24. A PIFA having a single feed and four frequency bands of resonance, comprising:

a dielectric carriage having a top surface and sidewalls that extend from said top surface;

said sidewalls having bottom surfaces that are spaced from and extends generally parallel to said top surface and that define a bottom surface;

a metal ground plane element generally abutting said bottom surface carriage;

a metal radiating element generally abutting said top surface;

said radiating element having a radiating edge and a non-radiating edge;

a metal shorting strip extending downward from said non-radiating edge and electrically connected to said ground plane element;

a metal feed strip extending downward from said non-radiating edge and having a free end that is spaced from said ground plane element;

a feed cable connected to said free end of said feed strip;

metal tuning plates extending downward from said radiating element in a generally abutting relationship with said sidewalls;

said metal tuning plates having free ends that are spaced from said ground plane element;

a generally C-shaped slot formed in said radiating element and interrupted by a conductive metal stub that is located adjacent to said radiating edge of said radiating element;

said generally C-shaped slot forming said radiating element into an inner radiating element and an outer radiating element that is electrically connected to said inner radiating element by said conductive metal stub; and an open slot on said non-radiating edge of said radiating element in a location that is between said shorting strip and said feed strip.

25. The PIFA of claim 24 wherein said generally C-shaped slot includes:

a first slot portion that extends from one side of said conductive metal stub generally parallel to said radiating edge;

a second slot portion that extends from said first slot portion generally perpendicular to said radiating edge;

a third slot portion that extends from said second slot portion generally parallel to said radiating edge;

a fourth slot portion that extends from said third slot portion generally perpendicular to said radiating edge; and a fifth slot portion that extends from said fourth slot portion generally parallel to said radiating edge to an opposite side of said conductive metal stub.

26. The PIFA of claim 25 wherein said open slot connects to said third slot portion of said generally C-shaped slot.

27. A PIFA having a single feed and four frequency bands of resonance, comprising:

a dielectric carriage having a top surface and a bottom surface that is defined by sidewalls that extend between said top surface and said bottom surface, said bottom surface being spaced from and extending generally parallel to said top surface;

a metal ground plane element generally abutting said bottom surface;

a metal radiating element generally abutting said top surface;

said radiating element having a radiating edge and a non-radiating edge;

a metal shorting strip extending downward from said non-radiating edge and electrically connected to said ground plane element;

a metal feed strip extending downward from said non-radiating edge and having a free end that is spaced from said ground plane element;

a feed cable connected to said free end of said feed strip;

metal tuning plates extending downward from said radiating element in a generally abutting relationship With said sidewalls;

said metal tuning plates having free ends that are spaced from said ground plane element;

a first generally C-shaped slot formed in said radiating element and interrupted by a first conductive metal stub that is located adjacent to said non-radiating edge;

a second generally C-shaped slot formed in said radiating element so as to generally surround said first generally C-shaped slot and interrupted by a second conductive metal stub that is located adjacent to said non-radiating edge;

said first generally C-shaped slot forming an inner radiating element;

said second generally C-shaped slot forming a middle radiating element that is connected to said inner radiating element by said first conductive metal stub; and said second generally C-shaped slot forming an outer radiating element that is electrically connected to said middle radiating element by said second conductive metal stub.

28. The PIFA of claim 27 wherein:

said first generally C-shaped slot includes a first slot portion extending from one side of said first conductive stub generally parallel to said non-radiating edge, a second slot portion extending from said first slot portion generally perpendicular to said non-radiating edge, a third slot portion extending from said second slot portion generally parallel to said non-radiating edge, a fourth slot portion extending from said third slot portion generally perpendicular to said non-radiating edge, and a fifth slot portion extending from said fourth slot portion generally parallel to said non-radiating edge to an opposite side of said first conductive stub; and said second generally C-shaped slot includes a first slot portion extending from one side of said second conductive stub generally parallel to said non-radiating edge, a second slot portion extending from said first slot portion generally perpendicular to said non-radiating edge, a third slot portion extending from said second slot portion generally parallel to said non-radiating edge, a fourth slot portion extending from said third slot portion generally perpendicular to said non-radiating edge, and a fifth slot portion extending from said fourth slot portion generally parallel to said non-radiating edge to an opposite side of said second conductive stub.

29. The PIFAS of claim 28 including:

a metal plate extending downward from said radiating edge in a generally abutting relationship with a sidewall of said dielectric carriage;

said metal plate having a free end spaced from said ground plane element; and a generally L-shaped slot formed in said metal plate;

said generally L-shaped slot having an open end located adjacent to said ground plane element, and having a slot segment that extends generally parallel to said radiating edge.

30. PIFA having a single feed and five frequency bands of resonance, comprising:

a dielectric carriage having a top surface, having a bottom surface that is spaced from and extends generally parallel to said top surface, and having sidewalls that extend between said top and bottom surfaces, said bottom surface being defined by bottom ends of said sidewalls;

a metal ground plane element generally abutting said bottom surface;

a metal radiating element generally abutting said top surface;

said radiating element having a radiating edge and a non-radiating edge;

a metal shorting strip extending downward from said non-radiating edge and electrically connected to said ground plane element;

a metal feed strip extending downward from said non-radiating edge and having a free end that is spaced from said ground plane element;

a feed cable connected to said free end of said feed strip;

metal plates extending downward from said radiating element and having feed ends that are spaced from said ground plane element;

a first generally L-shaped slot on said radiating element having an open end located on said non-radiating edge intermediate said shorting strip and said feed strip;

a second generally L-shaped slot on said radiating element having an open end located on said non-radiating edge; and a third slot on said radiating element located intermediate said first and second generally L-shaped slots having an open end located on said non-radiating edge intermediate said open ends of said first and second generally L-shaped slots.

31. The PIFA of claim 30 wherein:

said first and second generally L-shaped slots include a first slot portion extending generally perpendicular from said non-radiating edge, and a second slot portion extending from said first slot portion generally parallel to said non-radiating edge; and said third slot includes a first slot portion extending generally perpendicular from said non-radiating edge, a second slot portion extending from said first slot portion generally parallel to said non-radiating edge, a third slot portion extending from said second slot portion generally perpendicular to said non-radiating edge, and a fourth slot portion extending from said third slot portion generally parallel to said non-radiating edge.

32. The method of claim 31 wherein said downward extending metal plates are closely associated with said sidewalls of said dielectric carriage.

33. PIFA having a single feed and three frequency bands of resonance, comprising:

a dielectric carriage having a top surface and a bottom surface that is defined by sidewalls that extend form said top surface, said bottom surface being spaced from and generally parallel to said top surface;

a metal ground plane element generally abutting said bottom surface;

a metal radiating element generally abutting said top surface;

said radiating element having a radiating edge and a non-radiating edge;

a metal shorting strip extending downward from said non-radiating edge and electrically connected to said ground plane element;

a metal feed strip extending downward from said non-radiating edge and having a free end that is spaced from said ground plane element;

a feed cable connected to said free end of said feed strip;

metal plates extending downward from said radiating element in a generally abutting relationship with said sidewalls and having free ends that are spaced from said ground plane element;

a generally C-shaped slot formed in said radiating element;

a conductive metal stub located adjacent to said non-radiating edge of said radiating element and interrupting said generally C-shaped slot;

said generally C-shaped slot partitioning said radiating element into an inner radiating element and an outer radiating element that is electrically connected to said inner radiating element by said conductive metal stub;

a downward extending plate on said radiating edge of said radiating element; and a generally L-shaped slot in said downward extending plate;

said generally L-shaped slot having an open end located adjacent to said ground plane element.

34. The PIFA of claim 33 wherein:

said generally C-shaped slot includes a first slot portion extending from one side of said conductive stub generally parallel to said non-radiating edge, a second slot portion extending from said first slot portion generally perpendicular to said non-radiating edge, a third slot portion extending from said second slot portion generally parallel to said non-radiating edge, a fourth slot portion extending from said third slot portion generally perpendicular to said non-radiating edge, and a fifth slot portion extending from said fourth slot portion generally parallel to said non-radiating edge to an opposite side of said conductive stub; and said L-shaped slot includes a first slot portion that extends from said open end generally perpendicular to said radiating edge, and a second slot portion extending from said first slot portion generally parallel to said radiating edge.

* * * * *